US008843024B2

(12) United States Patent
Uematsu et al.

(10) Patent No.: US 8,843,024 B2
(45) Date of Patent: Sep. 23, 2014

(54) ELECTROPHOTOGRAPHIC PHOTOSENSITIVE MEMBER, PROCESS CARTRIDGE, AND ELECTROPHOTOGRAPHIC APPARATUS

(75) Inventors: Hiroki Uematsu, Suntou-gun (JP); Harunobu Ogaki, Suntou-gun (JP); Atsushi Ochi, Hino (JP); Yasuhiro Kawai, Susono (JP); Koji Takahashi, Suntou-gun (JP); Shio Murai, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/959,238

(22) Filed: Dec. 2, 2010

(65) Prior Publication Data

US 2011/0135340 A1 Jun. 9, 2011

Related U.S. Application Data

(63) Continuation of application No. PCT/JP2009/070391, filed on Dec. 4, 2009.

(51) Int. Cl.

| | |
|---|---|
| ***G03G 21/16*** | (2006.01) |
| ***G03G 15/00*** | (2006.01) |
| ***G03G 5/043*** | (2006.01) |
| ***G03G 5/10*** | (2006.01) |
| ***G03G 5/147*** | (2006.01) |

(52) U.S. Cl.

CPC ..... *G03G 5/043* (2013.01); *G03G 5/10* (2013.01); *G03G 5/147* (2013.01)

USPC ..... 399/111; 399/159

(58) Field of Classification Search

USPC ..... 399/159, 116

See application file for complete search history.

(56) References Cited

U.S. PATENT DOCUMENTS

| | | | | |
|---|---|---|---|---|
| 4,470,689 | A * | 9/1984 | Nomura et al. | 399/114 |
| 5,082,756 | A * | 1/1992 | Doi | 430/67 |
| 6,529,699 | B2 * | 3/2003 | Ishii et al. | 399/159 |
| 2001/0026708 | A1 | 10/2001 | Ishii et al. | |
| 2005/0069351 | A1 * | 3/2005 | Matsuo et al. | 399/286 |
| 2006/0008717 | A1 | 1/2006 | Uematsu et al. | |

FOREIGN PATENT DOCUMENTS

| | | | |
|---|---|---|---|
| CN | 1619435 | A | 5/2005 |
| CN | 101120287 | A | 2/2008 |
| CN | 101308357 | A | 11/2008 |
| CN | 101379437 | A | 3/2009 |
| EP | 1983373 | A1 | 10/2008 |

(Continued)

OTHER PUBLICATIONS

Machine translation of Tamoto, 2006-011047.*

*Primary Examiner* — David Gray
*Assistant Examiner* — Sevan A Aydin
(74) *Attorney, Agent, or Firm* — Canon USA Inc IP Division

(57) ABSTRACT

An electrophotographic photosensitive member having excellent cleaning performance, a process cartridge, and an electrophotographic apparatus.

The peripheral surface of the member has flat portions having a width e (μm) satisfying $0.1 \le e \le 25$ and a plurality of groove portions having a width w (μm) satisfying $0.1 \le w \le 25$ and a depth d (μm) satisfying $0.1 \le d \le 3.0$, the flat and groove portions at an angle θ (°) satisfying $80 \le \theta \le 100$ with respect to the axial direction of the member. The sum $e_{sum}$ (μm) of the widths e of the flat portions per each width of 100 μm in the axial direction of the peripheral surface satisfying $5 \le e_{sum} \le 75$, and $e_o/e_{Av}$ satisfying $e_o/e_{Av} \le 0.46$, where $e_{Av}$ (μm) is the average value of the widths e of the flat portions, and $e_o$ is the standard deviation thereof.

9 Claims, 10 Drawing Sheets

(56) References Cited

FOREIGN PATENT DOCUMENTS

| | | | |
|---|---|---|---|
| EP | 1983377 | A1 | 10/2008 |
| JP | 2001-066814 | A | 3/2001 |
| JP | 2004-279967 | A | 10/2004 |
| JP | 2006-11047 | A | 1/2006 |
| JP | 2010-026240 | A | 2/2010 |
| WO | 03/192961 | A1 | 3/2003 |
| WO | 2005-093519 | A1 | 10/2005 |

* cited by examiner

ELECTROPHOTOGRAPHIC PHOTOSENSITIVE MEMBER, PROCESS CARTRIDGE, AND ELECTROPHOTOGRAPHIC APPARATUS

CROSS-REFERENCE TO RELATED APPLICATIONS

This application is a Continuation of International Patent Application No. PCT/JP2009/070391, filed Dec. 4, 2009, which is hereby incorporated by reference herein in its entirety.

TECHNICAL FIELD

The present invention relates to an electrophotographic photosensitive member, a process cartridge, and an electrophotographic apparatus.

BACKGROUND ART

As electrophotographic photosensitive members, in view of advantages, such as low cost and high productivity, electrophotographic photosensitive members (organic electrophotographic photosensitive members) having a photosensitive layer (an organic photosensitive layer) which uses an organic material as a photoconductive substance (a charge generating substance or a charge transport substance) and which is disposed on a cylindrical support have been widely used. Furthermore, as organic electrophotographic photosensitive members, in view of advantages, such as high sensitivity and a possibility of designing various materials, electrophotographic photosensitive members having a lamination-type photosensitive layer in which a charge generation layer containing a charge generating substance and a charge transport layer containing a charge transport substance are stacked have been mainly used.

Since electrical/mechanical external forces due to charging, exposure, development, transfer, cleaning, and the like are applied to the peripheral surface of an electrophotographic photosensitive member, many problems are caused by these forces. Specific examples of the problems include degradation in durability due to flaws and abrasion on the peripheral surface of the electrophotographic photosensitive member, degradation in transfer efficiency, melt adhesion of toner, and image defects due to inadequate cleaning.

In dealing with the problems, it is known to be effective to roughen the peripheral surface of the electrophotographic photosensitive member for the purpose of imparting releasability and lubricity. Specifically, by roughening of the peripheral surface of the electrophotographic photosensitive member, when a toner, a charging member, a transferring member, a cleaning member, or the like is brought into contact with the peripheral surface of the electrophotographic photosensitive member, the contact area can be reduced. Consequently, effects of improving releasability and reducing frictional force are expected. The frictional force between the peripheral surface of the electrophotographic photosensitive member and the cleaning blade is particularly large, resulting in degradation in cleaning performance and degradation in durability of the electrophotographic photosensitive member, which is likely to cause problems.

Although the detailed mechanism is not known, in general, a developer, in particular, an external additive, is considered to be significantly involved in cleaning. Specifically, it is considered that a developer, in particular; an external additive, intervenes between the cleaning blade and the peripheral surface of the electrophotographic photosensitive member and functions as a granular lubricant, thus enabling stable cleaning. Consequently, in the case where image formation is continuously performed at a normal image density, by sufficiently supplying the granular lubricant between the cleaning blade and the peripheral surface of the electrophotographic photosensitive member, stable cleaning performance is exhibited.

However, for example, in the case where image formation is performed at a low coverage rate, in the case where monochrome image formation is performed in a tandem electrophotographic apparatus, or in the case where image formation is performed using an electrophotographic apparatus having very high transfer efficiency, the supply of the granular lubricant tends to become insufficient. When the supply of the granular lubricant between the cleaning blade and the peripheral surface of the electrophotographic photosensitive member becomes insufficient, cleaning performance tends to be degraded. Specific examples of the degradation in cleaning performance include inadequate cleaning due to chattering and turning up of the cleaning blade and fracturing and chipping of the edge portion of the cleaning blade. Here, the term "chattering" refers to a phenomenon in which an increase in frictional resistance between the cleaning blade and the peripheral surface of the electrophotographic photosensitive member causes the cleaning blade to vibrate. Furthermore, the expression "turning up of the cleaning blade" refers to a phenomenon in which the cleaning blade which abuts against the peripheral surface of the electrophotographic photosensitive member in a direction opposite to the moving direction of the peripheral surface of the electrophotographic photosensitive member is reversed so as to abut in the direction of the moving direction of the peripheral surface of the electrophotographic photosensitive member.

Furthermore, specific examples of the degradation in durability of the electrophotographic photosensitive member include an increase in the abrasion loss of the surface layer of the electrophotographic photosensitive member resulting from an increase in frictional resistance and occurrence of flaws due to local concentration of pressure.

In dealing with the problems, roughening of the peripheral surface of the electrophotographic photosensitive member is considered to be effective from the standpoint of reducing the cleaning load. However, currently, a further improvement is required for surface roughening techniques.

As the technique of roughening the peripheral surface of the electrophotographic photosensitive member, methods of grinding the peripheral surface of the electrophotographic photosensitive member using various mechanical means have been known.

PTL 1 discloses, in order to solve various problems, such as cleaning, a technique of roughening the peripheral surface of an electrophotographic photosensitive member (in which groove portions are formed, in the substantially circumferential direction, on the peripheral surface of the electrophotographic photosensitive member), using an abrasive tape (film-shaped abrasive).

Furthermore, PTL 2 discloses a technique of forming a protrusion/recess shape on the surface of an electrophotographic photosensitive member by subjecting the surface of the electrophotographic photosensitive member to a compression molding process using a stamper having protrusions and recesses on its surface. Specifically, PTL 2 discloses a technique of forming a shape in which peaks having apexes and valleys are regularly continued in a direction at an angle with respect to the axial direction of the electrophotographic photosensitive member, i.e., a shape provided with groove portions, on the surface of an electrophotographic photosensitive member. According to this method, it has been reported that releasability of toner is improved and the nip pressure of the cleaning blade can be reduced, thereby reducing abrasion of the electrophotographic photosensitive member.

CITATION LIST

Patent Literature

PTL 1 Pamphlet of International Publication No. 2005/093519

PTL 2 Japanese Patent Laid-Open No. 2001-066814

However, in the shape of the peripheral surface of the electrophotographic photosensitive member, roughened by the technique described in PTL 1, it has been found that, when the contact pressure of the cleaning blade to the peripheral surface of the electrophotographic photosensitive member is decreased, inadequate cleaning due to slip-through of toner tends to easily occur. Although the detailed reasons for this are not known, the present inventors assume that one of the factors responsible for the inadequate cleaning is that, in the peripheral surface of the electrophotographic photosensitive member, roughened with mechanical grinding means, such as a film-shaped abrasive, groove portions and non-groove portions (flat portions) are not arranged in a uniformly controlled manner, but are arranged nonuniformly. When the cleaning state is microscopically observed, flat portions dominate portions in contact with the cleaning blade in the peripheral surface of the electrophotographic photosensitive member. However, the fact that the width of the flat portions is nonuniform with respect to the axial direction of the electrophotographic photosensitive member or that the peripheral surface has a part where flat portions are absent and groove portions are continuously present is believed to make the behavior of the cleaning blade unstable. Furthermore, regarding the transferability of a toner image from the peripheral surface of an electrophotographic photosensitive member to a transfer medium, there are also concerns that nonuniformity in the arrangement of flat portions or partial absence of flat portions may result in a reduction in dot reproducibility and dot nonuniformity due to hollow defects.

Furthermore, in the electrophotographic photosensitive member, described in PTL 2, having the peripheral surface with a shape in which groove portions are continuously disposed and flat portions are not present, it has been found that, when the contact pressure of the cleaning blade to the peripheral surface of the electrophotographic photosensitive member is decreased, inadequate cleaning due to slip-through of toner tends to easily occur. Moreover, it has been found that the inadequate cleaning easily occurs, in particular, under a low-temperature environment. Although the detailed reasons for this are not known, when the cleaning state is microscopically observed, the fact that the number of flat portions in contact with the cleaning blade is extremely small is believed to make the behavior of the cleaning blade unstable. Furthermore, although transfer efficiency increases, there is also a concern on dot nonuniformity due to flowing of toner from the standpoint of dot reproducibility.

As described above, in the conventional techniques, certain effects are recognized on improvement of cleaning performance, improvement of durability of the electrophotographic photosensitive member, and suppression of image defects.

However, with the spheroidization and size reduction of toner accompanying an increase in resolution in recent years, a dramatic improvement in cleaning performance is currently desired. In particular, in order to cope with higher speed, a size reduction of the main body of the electrophotographic apparatus, and enhanced energy conservation, which are expected to be accelerated, stable cleaning performance is desired.

It is an object of the present invention to solve the problems described above and to provide an electrophotographic photosensitive member having excellent cleaning performance, and a process cartridge and an electrophotographic apparatus, each including the electrophotographic photosensitive member. It is another object of the present invention to provide an electrophotographic photosensitive member which has good dot reproducibility even if the peripheral surface is roughened, and a process cartridge and an electrophotographic apparatus, each including the electrophotographic photosensitive member.

SUMMARY OF INVENTION

The present inventors have conducted diligent studies, and as a result, have found that the problems described above can be solved by forming a shape having certain flat portions and groove portions on a peripheral surface of an electrophotographic photosensitive member. Thus, the present invention has been completed.

That is, according to the present invention, an electrophotographic photosensitive member includes a cylindrical support and a photosensitive layer disposed on the cylindrical support, the electrophotographic photosensitive member being characterized in that a peripheral surface of the electrophotographic photosensitive member has a plurality of flat portions having a width e (μm) that satisfies the relationship $0.1 \le e \le 25$ and a plurality of groove portions having a width w (μm) that satisfies the relationship $0.1 \le w \le 25$ and a depth d (μm) that satisfies the relationship $0.1 \le d \le 3.0$, the flat portions and the groove portions being alternately formed at an angle θ (°) that satisfies the relationship $80 \le \theta \le 100$ with respect to the axial direction of the electrophotographic photosensitive member; the sum $e_{sum}$ (μm) of the widths e of the flat portions per each width of 100 μm in the axial direction of the peripheral surface satisfies the relationship $5 \le e_{sum} \le 75$; and $e_o/e_{Av}$ satisfies the relationship $e_o/e_{Av} \le 0.46$, where $e_{Av}$ (μm) is the average value of the widths e of the flat portions, and $e_o$ is the standard deviation thereof.

Furthermore, according to the present invention, a process cartridge integrally holds at least one means selected from the group consisting of the electrophotographic photosensitive member described above, charging means for charging a peripheral surface of the electrophotographic photosensitive member, developing means for developing an electrostatic latent image formed on the peripheral surface of the electrophotographic photosensitive member with a toner to form a toner image on the peripheral surface of the electrophotographic photosensitive member, transferring means for transferring the toner image formed on the peripheral surface of the electrophotographic photosensitive member to a transfer medium, and cleaning means for removing toner remaining on the peripheral surface of the electrophotographic photosensitive member after the toner image formed on the peripheral surface of the electrophotographic photosensitive member has been transferred to the transfer medium, the process cartridge being characterized by being detachably mountable to a main body of an electrophotographic apparatus.

Furthermore, according to the present invention, an electrophotographic apparatus is characterized by including the electrophotographic photosensitive member described above, charging means for charging the electrophotographic photosensitive member, exposing means for irradiating, with exposure light, a peripheral surface of the electrophotographic photosensitive member which has been charged to form an electrostatic latent image on the peripheral surface of the electrophotographic photosensitive member, developing means for developing the electrostatic latent image formed on the surface of the electrophotographic photosensitive member with a toner to form a toner image on the peripheral surface of the electrophotographic photosensitive member, and transferring means for transferring the toner image formed on the peripheral surface of the electrophotographic photosensitive member to a transfer medium.

Further features of the present invention will become apparent from the following description of exemplary embodiments with reference to the attached drawings.

DESCRIPTION OF EMBODIMENTS

Figure 1:
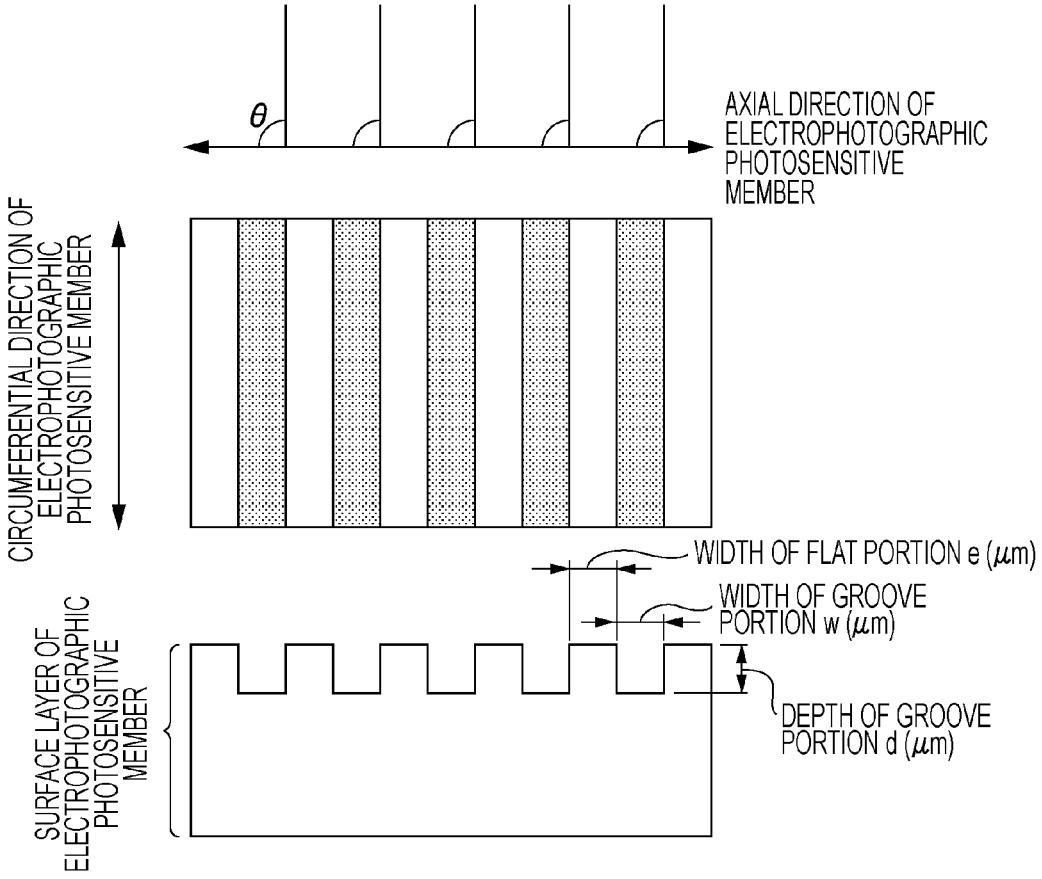
FIG. 1 includes a surface view and a cross-sectional view showing an example of a flat portion/groove portion shape formed on a peripheral surface of an electrophotographic photosensitive member.

The present invention is characterized in that a peripheral surface of an electrophotographic photosensitive member has a shape including flat portions and groove portions (hereinafter, also referred to as a "flat portion/groove portion shape"), and that uniformity of the flat portion/groove portion shape is high. Specifically, the peripheral surface of the electrophotographic photosensitive member has a plurality of flat portions having a width e (μm) that satisfies the relationship $0.1 \leq e \leq 25$ and a plurality of groove portions having a width w (μm) that satisfies the relationship $0.1 \leq w \leq 25$ and a depth d (μm) that satisfies the relationship $0.1 \leq d \leq 3.0$, the flat portions and the groove portions being alternately formed at an angle θ (°) that satisfies the relationship $80 \leq \theta \leq 100$ with respect to the axial direction of the electrophotographic photosensitive member. The sum $e_{sum}$ (μm) of the widths e of the flat portions per each width of 100 μm in the axial direction of the peripheral surface satisfies the relationship $5 \leq e_{sum} \leq 75$, and $e_o/e_{Av}$ satisfies the relationship $e_o/e_{Av} \leq 0.46$, where $e_{Av}$ (μm) is the average value of the widths e of the flat portions, and $e_o$ is the standard deviation thereof.

In the case where a flat portion/groove portion shape is formed on a peripheral surface of an electrophotographic photosensitive member using an abrasive tape as described in PTL 1, it is difficult to enhance the uniformity of the fine flat portion/groove portion shape in the axial direction of the electrophotographic photosensitive member. In contrast, when a method of forming a flat portion/groove portion shape by mold compression is employed, the flat portion/groove portion shape can be easily controlled. As a result of studies on the performance of various electrophotographic photosensitive members using the mold compression method, it has been found that, by uniformly controlling the width e of flat portions in the flat portion/groove portion shape, even if the contact pressure of the cleaning blade to the peripheral surface of the electrophotographic photosensitive member is decreased, cleaning performance greatly improves. The reason for this is believed to be that, since the microscopic contact state between the cleaning blade and the peripheral surface of the electrophotographic photosensitive member is stabilized, micro-vibration of the cleaning blade decreases, and thus good cleaning performance is exhibited. In particular, even in a low-temperature environment in which it is difficult to decrease the contact pressure of the cleaning blade to the peripheral surface of the electrophotographic photosensitive member, the electrophotographic photosensitive member of the present invention exhibits good cleaning performance. Furthermore, it has been found that, by uniformly controlling the width w and the depth d of groove portions in the flat portion/groove portion shape, even in the electrophotographic photosensitive member, the peripheral surface of which is roughened, a reduction in dot reproducibility and dot nonuniformity due to hollow defects are further suppressed.

Furthermore, according to the present invention, the contact pressure of the cleaning blade to the peripheral surface of the electrophotographic photosensitive member can be decreased. When the contact pressure is decreased, it is possible to reduce frictional force between the peripheral surface of the electrophotographic photosensitive member and the cleaning blade. Consequently, it is possible to suppress the temperature rise of the electrophotographic photosensitive member, the load of a motor for rotating the photosensitive member, and degradation in the durability of the electrophotographic photosensitive member due to abrasion and flaws.

Furthermore, in general, by decreasing the contact area between a cleaning blade and the peripheral surface of an electrophotographic photosensitive member to reduce frictional force, cleaning performance tends to be improved. However, it has been found that, in the case where flat portions are eliminated and the contact area is greatly decreased as described in PTL 2, cleaning performance is degraded. The degradation in the cleaning performance is particularly noticeable in the case where the contact pressure of the cleaning blade to the peripheral surface of the electrophotographic photosensitive member is decreased. In contrast, in the case where the cleaning blade is brought into contact with (abutted against) the peripheral surface of the electrophotographic photosensitive member in which uniformity of flat portions is high in the flat portion/groove portion shape as in the present invention, the microscopic contact state between the cleaning blade and the peripheral surface of the electrophotographic photosensitive member is stabilized. Thereby, micro-vibration of the cleaning blade decreases, and good cleaning performance is exhibited. Furthermore, because of the presence of highly uniform flat portions, toner flow is suppressed when a toner image formed on the peripheral surface of the electrophotographic photosensitive member is transferred to a transfer medium, and good dot reproducibility is obtained.

FIG. 1 includes a surface view and a cross-sectional view showing an example of a flat portion/groove portion shape formed on a peripheral surface of an electrophotographic photosensitive member in the present invention. In FIG. 1, a plurality of flat portions having a width e (μm) and a plurality of groove portions having width w (μm) and a depth d (μm) are alternately formed on the peripheral surface of the electrophotographic photosensitive member.

As described above, the width e (μm) of the flat portions is in the range $0.1 \leq e \leq 25$. When the width e (μm) of the flat portions exceeds 25 μm, the contact area between the cleaning blade and the peripheral surface of the electrophotographic photosensitive member in the axial direction of the electrophotographic photosensitive member increases, and the effect of reducing frictional force tends to decrease. On the other hand, when the width e (μm) of the flat portions is smaller than 0.1 μm, since the contact area decreases, the behavior of the cleaning blade tends to become unstable. Furthermore, when the width e of the flat portions is smaller than 0.1 μm, dot reproducibility tends to decrease during transferring of a toner image formed on the peripheral surface of the electrophotographic photosensitive member to a transfer medium. Preferably, flat portions having a width e (μm) smaller than 0.1 μm are not formed on the peripheral surface of the electrophotographic photosensitive member. Furthermore, preferably, flat portions having a width e (μm) larger than 25 μm are not formed on the peripheral surface of the electrophotographic photosensitive member.

Furthermore, as described above, the width w (μm) of the groove portions is in the range $0.1 \leq w \leq 25$. When the width w (μm) of the groove portions exceeds 25 μm, since the width becomes close to the exposure spot diameter of a laser beam generally used for image exposure during image formation, there may be influence of scattering and transferability of the toner image formed on the peripheral surface of the electrophotographic photosensitive member tends to become non-uniform. On the other hand, when the width w (μm) of the groove portions is smaller than 0.1 μm, the contact area between the cleaning blade and the peripheral surface of the electrophotographic photosensitive member increases, and the effect of reducing frictional force decreases. Therefore, the behavior of the cleaning blade tends to become unstable. Preferably, groove portions having a width w (μm) smaller than 0.1 μm are not formed on the peripheral surface of the electrophotographic photosensitive member. Furthermore, preferably, groove portions having a width w (μm) larger than 25 μm are not formed on the peripheral surface of the electrophotographic photosensitive member.

Furthermore, as described above, the depth d (μm) of the groove portions is in the range $0.1 \leq d \leq 3.0$. When the depth d (μm) exceeds 3.0 μm, the groove portions tend to appear as image defects. On the other hand, when the depth d (μm) of the groove portions is smaller than 0.1 μm, the effect of reducing frictional force tends to decrease. Preferably, groove portions having a depth d (μm) smaller than 0.1 μm are not formed on the peripheral surface of the electrophotographic photosensitive member. Furthermore, preferably, groove portions having depth d (μm) larger than 3.0 μm are not formed on the peripheral surface of the electrophotographic photosensitive member.

In the present invention, the groove portions along with the flat portions are formed on the peripheral surface of the electrophotographic photosensitive member substantially perpendicular, at an angle of 90°±10°, with respect to the axial direction of the electrophotographic photosensitive member. That is, in the present invention, a plurality of groove portions are formed on the peripheral surface of the electrophotographic photosensitive member at an angle θ (°) that satisfies the relationship $80 \leq \theta \leq 100$ (for example, θ in FIG. 1). When the angle θ (°) departs from the range $80 \leq \theta \leq 100$, the flat portion/groove portion shape is easily lost by repeated use, and the advantageous effects of the present invention tend not to be obtained.

Furthermore, in the flat portion/groove portion shape formed on the peripheral surface of the electrophotographic photosensitive member of the present invention, the sum $e_{sum}$ (μm) of the widths e of the flat portions per each width of 100 μm in the axial direction of the peripheral surface of the electrophotographic photosensitive member satisfies the relationship $5 \leq e_{sum} \leq 75$. When the sum $e_{sum}$ (μm) exceeds 75 μm, frictional force between the cleaning blade and the peripheral surface of the electrophotographic photosensitive member increases, and inadequate cleaning tends to easily occur. On the other hand, from the standpoint of decreasing the frictional force between the cleaning blade and the peripheral surface of the electrophotographic photosensitive member, a smaller sum $e_{sum}$ (μm) is preferable. However, as the sum $e_{sum}$ (μm) becomes smaller than 5 μm and the percentage occupied by the flat portions decreases, the advantageous effects of the present invention tend to decrease. Therefore, the sum $e_{sum}$ (μm) is required to be 5 μm or more. More preferably, $10 \leq e_{sum} \leq 50$.

Furthermore, in the flat portion/groove portion shape formed on the peripheral surface of the electrophotographic photosensitive member of the present invention, the variation in width e (μm) of the flat portions, the variation in width w (μm) of the groove portions, and the variation in depth d (μm) of the groove portions are preferably small. That is, standard deviations $e_\sigma$, $w_\sigma$, and $d_\sigma$ of the average value $e_{Av}$ (μm) of the widths e of the flat portions, the average value $w_{Av}$ (μm) of the widths w of the groove portions, and the average value $d_{Av}$ (μm) of the depths of the groove portions, respectively, are preferably small. In particular, it is important to enhance uniformity of width of the flat portions that are in contact with the cleaning blade because of the direct involvement with the advantageous effects of the present invention. Specifically, the relationship $e_\sigma/e_{Av} \leq 0.46$ is required to be satisfied. Preferably, $e_\sigma/e_{Av} \leq 0.27$, and more preferably, $e_\sigma/e_{Av} \leq 0.08$. Furthermore, with respect to the uniformity of width of the groove portions, preferably, $w_\sigma/w_{Av} \leq 0.08$. Furthermore, with respect to the uniformity of depth of the groove portions, preferably, $d_\sigma/d_{Av} \leq 0.08$. When the width of the flat portions, the width of the groove portions, and the depth of the groove portions are uniform, the microscopic contact state between the peripheral surface of the electrophotographic photosensitive member and the cleaning blade is stabilized, and the advantageous effects of the present invention tend to be markedly obtained. Furthermore, with respect to dot reproducibility and transferability, it is also effective to uniformize the width of the flat portions, the width of the groove portions, and the depth of the groove portions as described above.

In order to markedly obtain the advantageous effects of the present invention, the flat portion/groove portion shape according to the present invention is formed at least in a region in contact with the cleaning blade in the peripheral surface of the electrophotographic photosensitive member.

Next, a method of observing the flat portion/groove portion shape of the peripheral surface of the electrophotographic photosensitive member and a data processing method in the present invention will be described in detail.

In the present invention, the flat portion/groove portion shape of the peripheral surface of the electrophotographic photosensitive member can be measured, for example, using a commercially available laser microscope, optical microscope, electron microscope, atomic force microscope, or the like.

Examples of the laser microscope that can be used include the following equipment:

An ultra-deep profile measuring microscope VK-8550, an ultra-deep profile measuring microscope VK-9000, and an ultra-deep profile measuring microscope VK-9500 (each of which is manufactured by Keyence Corporation); a surface profile measuring system Surface Explorer model SX-520DR (manufactured by Ryoka Systems Inc.); a confocal scanning laser microscope OLS3000 (manufactured by Olympus Corporation); and a real color confocal microscope OPTELICS C130 (manufactured by Lasertec Corporation).

Examples of the optical microscope that can be used include the following equipment:

A digital microscope VHX-500 and a digital microscope VHX-200 (each of which is manufactured by Keyence Corporation); and a 3D digital microscope VC-7700 (manufactured by OMRON Corporation).

Examples of the electron microscope that can be used include the following equipment:

A 3D real surface view microscope VE-9800 and a 3D real surface view microscope VE-8800 (each of which is manufactured by Keyence Corporation); a scanning electron microscope Conventional/Variable Pressure SEM (manufactured by SII NanoTechnology Inc.); and a scanning electron microscope SUPERSCAN SS-550 (manufactured by Shimadzu Corporation).

Examples of the atomic force microscope that can be used include the following equipment:

A nanoscale hybrid microscope VN-8000 (manufactured by Keyence Corporation), a scanning probe microscope NanoNavi station (manufactured by SII NanoTechnology Inc.), and a scanning probe microscope SPM-9600 (manufactured by Shimadzu Corporation).

Using any of the microscopes described above, at a predetermined magnification, the size and the like of the flat portions and groove portions in a field of view to be measured can be measured. Specifically, the widths e of the flat portions and the widths w and depths d of the groove portions in the field of view can be measured. Furthermore, the average width $e_{Av}$ of the flat portions, the standard deviation $e_\sigma$ thereof, the average width $w_{Av}$ of the groove portions, the standard deviation $w_\sigma$ thereof, the average depth $d_{Av}$, the standard deviation $d_\sigma$ thereof, and the sum of the widths of the flat portions, per unit length in the field of view, can be calculated.

Note that the values of $e_{Av}$, $e_\sigma$, $w_{Av}$, $w_\sigma$, $d_{Av}$, $d_\sigma$, and $e_{sum}$ were obtained by observing a 100 μm square (10,000 $\mu m^2$) region provided in each of 100 parts obtained by dividing the peripheral surface of the electrophotographic photosensitive member to be measured into four equal parts in the rotation direction of the electrophotographic photosensitive member and dividing each of the four equal parts into 25 equal parts in the direction perpendicular to the rotation direction of the electrophotographic photosensitive member, and finally calculating the averages of the observed values in 100 parts.

[Method of Forming Flat Portion/Groove Portion Shape on Peripheral Surface of Electrophotographic Photosensitive Member]

In the present invention, by bringing a mold having a predetermined protrusion/recess shape into pressure contact with the peripheral surface of an electrophotographic photosensitive member to transfer the shape of the mold (hereinafter, may also be referred to as "shape transfer"), it is possible to obtain the electrophotographic photosensitive member having a flat portion/groove portion shape on its peripheral surface.

Figure 2:
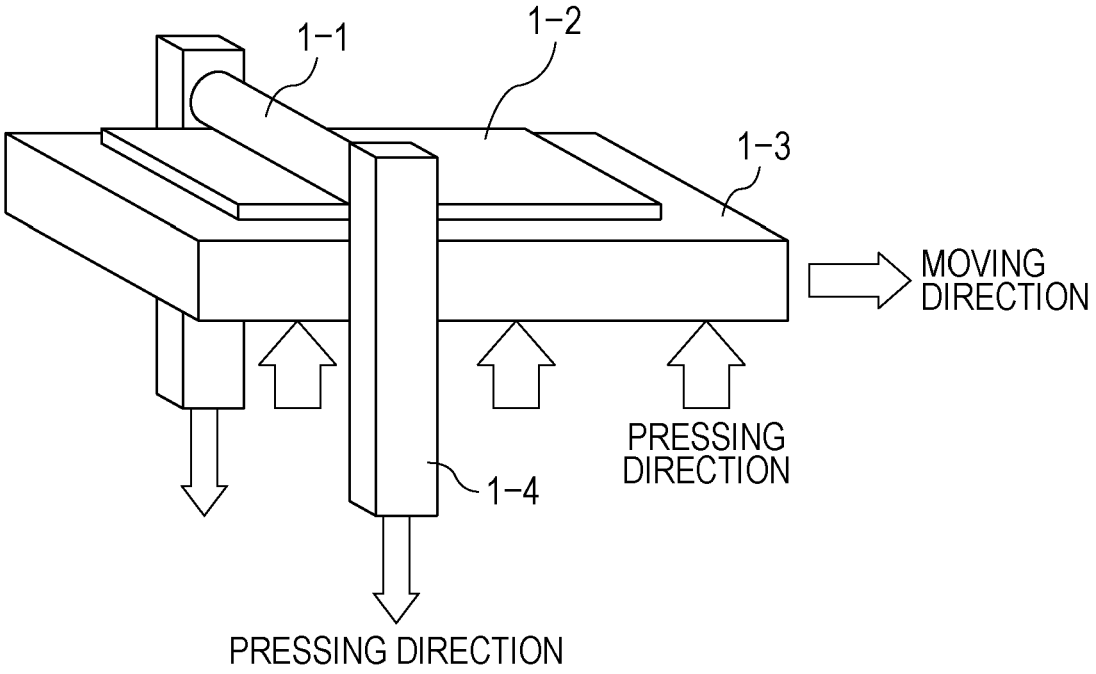
FIG. 2 is a view showing an example of a pressure-contact shape transfer processing apparatus with a mold.
Figure 3:
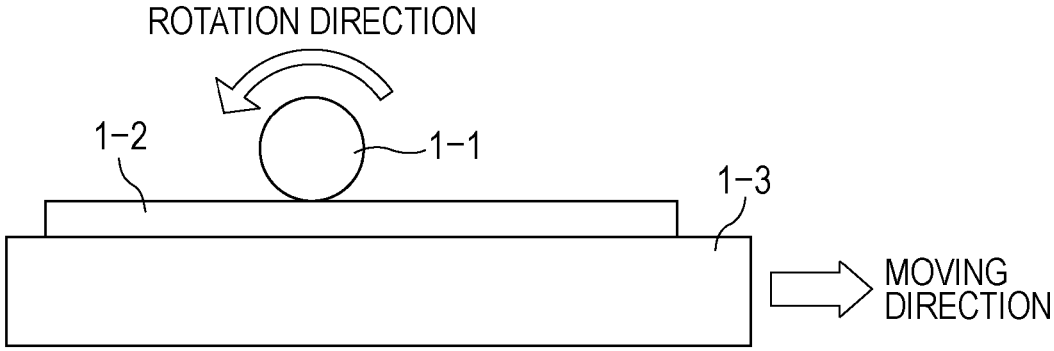
FIG. 3 is a view showing another example of a pressure-contact shape transfer processing apparatus with a mold.

FIGS. 2 and 3 are each a view showing an example of a pressure-contact shape transfer processing apparatus with a mold.

In these pressure-contact shape transfer processing apparatuses, while rotating an electrophotographic photosensitive member 1-1, on which shape transfer is to be performed, its peripheral surface is continuously brought into contact with a mold 1-2 and a pressure is applied. Thereby, a flat portion/groove portion shape can be formed on the peripheral surface of the electrophotographic photosensitive member.

In each of FIGS. 2 and 3, the size and shape of a pressure member 1-3 are determined depending on the processing pressure and the processing area. Furthermore, as the material for the pressure member 1-3, for example, a metal, a metal oxide, plastic, or glass can be used. Among these, in view of mechanical strength, dimensional accuracy, and durability, stainless steel (SUS) is preferably used. In the pressure member 1-3, a mold is placed on the upper surface thereof, and by bringing the mold into contact with the peripheral surface of the electrophotographic photosensitive member 1-1, on which shape transfer is to be performed and which is supported by a supporting member 1-4, under a predetermined pressure by a supporting member (not shown) on the lower surface of the pressure member 1-3 and a pressure system, shape transfer can be performed. Furthermore, a method may be employed in which pressing is performed by pressing a supporting member which holds an electrophotographic photosensitive member against a pressure member, or a method may be employed in which pressure is applied to both of them.

In the example shown in FIG. 2, as the pressure member 1-3 moves, the electrophotographic photosensitive member 1-1, on which shape transfer is to be performed, is rotated following the movement or driven to rotation, and thereby, the peripheral surface is processed continuously. Instead of this example, by the movement of the supporting member 1-4, the peripheral surface of the electrophotographic photosensitive member 1-1, on which shape transfer is to be performed, may be processed continuously.

In addition, for the purpose of efficiently performing shape transfer, the mold or the electrophotographic photosensitive member is preferably heated.

The material, size, and shape of the mold can be appropriately selected. Examples of the material for the mold include a metal or a resin film subjected to fine surface processing, a material obtained by performing patterning onto the surface of a silicon wafer or the like with a resist, a resin film in which fine particles are dispersed, and a material obtained by applying a metal coating to a resin film having a predetermined fine surface shape.

Furthermore, an elastic body can be placed between a mold and a pressure device for the purpose of uniformizing a pressure to be applied to an electrophotographic photosensitive member.

[Electrophotographic Photosensitive Member]

The electrophotographic photosensitive member of the present invention includes a cylindrical support (hereinafter, may be simply referred to as a "support") and a photosensitive layer disposed on the cylindrical support.

Furthermore, in the present invention, preferably, the electrophotographic photosensitive member has a surface layer composed of a crosslinked organic polymer.

As the photosensitive layer, a photosensitive layer (organic photosensitive layer) which uses an organic material as a photoconductive substance (a charge generating substance or a charge transport substance) is preferable. Furthermore, the photosensitive layer may be a single-layer-type photosensitive layer containing a charge transport substance and a charge generating substance in the same layer, or may be a lamination-type (separated-function-type) photosensitive layer in which a charge generation layer containing a charge generating substance and a charge transport layer containing a charge transport substance are separated. In the present invention, in view of electrophotographic characteristics, a lamination-type photosensitive layer is preferable. Furthermore, the lamination-type photosensitive layer may be a normal-order-type photosensitive layer in which a charge generation layer and a charge transport layer are stacked in that order from the support side, or a reverse-order-type photosensitive layer in which a charge transport layer and a charge generation layer are stacked in that order from the support side. Furthermore, in the present invention, when the lamination-type photosensitive layer is employed, the charge generation layer may have a laminated structure, or the charge transport layer may have a laminated structure. Furthermore, for the purpose of improving durability of the electrophotographic photosensitive member, a protective layer can be provided on the photosensitive layer.

As the material for the support, a material that exhibits conductivity (conductive support) can be used. Examples thereof include a support made of a metal (alloy), such as iron, copper, gold, silver, aluminum, zinc, titanium, lead, nickel, tin, antimony, indium, chromium, an aluminum alloy, or stainless steel. Furthermore, the above-mentioned metal support or a plastic support having a layer coated with a film formed by vacuum-depositing aluminum, an aluminum alloy, or an indium oxide-tin oxide alloy, may also be used. Furthermore, a support obtained by impregnating a plastic or paper with conductive particles, such as carbon black, tin oxide particles, titanium oxide particles, or silver particles, together with a suitable binder resin, or a plastic support having a conductive binder resin may also be used.

The surface of the support may be subjected to cutting treatment, surface-roughening treatment, or alumite treatment for the purpose of suppressing interference fringes due to scattering of laser light.

A conductive layer may be provided between the support and an intermediate layer, which will be described later, or the photosensitive layer (including the charge generation layer and the charge transport layer) for suppressing interference fringes due to scattering of laser light and covering flaws on the support.

The conductive layer can be formed by using an application liquid for the conductive layer prepared by dispersing and/or dissolving carbon black, conductive particles, a resistance-adjusting pigment, and the like together with a binder resin in a solvent. A compound that is cured and polymerized by heating or radiation irradiation may be added to the application liquid for the conductive layer. The surface of a conductive layer in which conductive particles and a resistance-adjusting pigment are dispersed tends to be roughened.

The thickness of the conductive layer is preferably 0.2 μm or more and 40 μm or less, more preferably 1 μm or more and 35 μm or less, and still more preferably 5 μm or more and 30 μm or less.

Examples of the binder resin used for the conductive layer include polymers/copolymers of vinyl compounds, such as styrene, vinyl acetate, vinyl chloride, acrylate esters, methacrylate esters, vinylidene fluoride, and trifluoroethylene; and also include polyvinyl alcohol, polyvinyl acetal, polycarbonate, polyester, polysulfone, polyphenylene oxide, polyurethane, cellulose resins, phenol resins, melamine resins, silicon resins, and epoxy resins.

Furthermore, examples of the conductive particles and the resistance-adjusting pigment include particles of metals (alloys), such as aluminum, zinc, copper, chromium, nickel, silver, and stainless steel; and materials obtained by vapor-depositing these metals on the surfaces of plastic particles. It is also possible to use particles of metal oxides, such as zinc oxide, titanium oxide, tin oxide, antimony oxide, indium oxide, bismuth oxide, tin-doped indium oxide, and antimony- or tantalum-doped tin oxide. These may be used alone or in combination of two or more. When two or more are used in combination, they may be simply mixed. Alternatively, they may be formed into a solid solution or may be fusion-bonded together.

An intermediate layer having a barrier function or an adhesion function may be provided between the support and the conductive layer or the photosensitive layer (including the charge generation layer and the charge transport layer). The intermediate layer is formed in order to improve adhesiveness of the photosensitive layer, to improve coating properties, to improve charge injection properties from the support, and to protect the photosensitive layer from electrical breakdown.

Examples of the material for the intermediate layer include polyvinyl alcohol, poly-N-vinylimidazole, polyethylene oxide, ethyl cellulose, ethylene-acrylic acid copolymers, casein, polyamide, N-methoxymethylated 6 nylon, copolymerized nylon, glue, and gelatin.

The intermediate layer can be formed by applying an application liquid for the intermediate layer prepared by dissolving any the materials described above in a solvent, followed by drying.

The thickness of the intermediate layer is preferably 0.05 μm or more and 7 μm or less, and more preferably 0.1 μm or more and 2 μm or less.

Examples of the charge generating substance that can be used in the present invention include pyrylium; thiapyrylium-based dyes; phthalocyanine pigments having various central metals and various crystal systems (e.g., α, β, γ, ϵ, and X types); anthanthrone pigments; dibenzpyrenequinone pigments; pyranthrone pigments; azo pigments, such as monoazo, disazo, and trisazo pigments; indigo pigments; quinacridone pigments; asymmetric quinocyanine pigments; quinocyanine pigments; and amorphous silicon. These charge generating substances may be used alone or in combination of two or more.

Examples of the charge transport substance that can be used in the present invention include pyrene compounds, N-alkylcarbazole compounds, hydrazone compounds, N,N-dialkylaniline compounds, diphenylamine compounds, triphenylamine compounds, triphenylmethane compounds, pyrazoline compounds, styryl compounds, and stilbene compounds.

In the case where the photosensitive layer is functionally separated into a charge generation layer and a charge transport layer, the charge generation layer can be formed by applying an application liquid for the charge generation layer prepared by dispersing a charge generating substance together with a binder resin and a solvent, followed by drying. The binder resin is preferably used in an amount 0.3 to 4 times that of the charge generating substance (mass ratio). The dispersion treatment may be performed, for example, by a method using a dispersion apparatus, such as a homogenizer, an ultrasonic dispersion apparatus, a ball mill, a vibrating ball mill, a sand mill, an attritor, or a roll mill. Alternatively, the charge generation layer may be a film obtained by vapor deposition of a charge generating substance.

The charge transport layer can be formed by applying an application liquid for the charge transport layer prepared by dissolving a charge transport substance and a binder resin in a solvent, followed by drying. Furthermore, among the above-mentioned charge transport substances, when a substance which has film-forming properties in itself is used, the charge transport layer can be formed using the substance alone without using a binder resin.

Examples of the binder resin that can be used for each of the charge generation layer and the charge transport layer include polymers or copolymers of vinyl compounds, such as styrene, vinyl acetate, vinyl chloride, acrylate esters, methacrylate esters, vinylidene fluoride, and trifluoroethylene; and also include polyvinyl alcohol, polyvinyl acetal, polycarbonate, polyester, polysulfone, polyphenylene oxide, polyurethane, cellulose resins, phenol resins, melamine resins, silicon resins, and epoxy resins.

The thickness of the charge generation layer is preferably 5 μm or less, and more preferably 0.1 μm or more and 2 μm or less.

The thickness of the charge transport layer is preferably 5 μm or more and 50 μm or less, and more preferably 10 μm or more and 35 μm or less.

In the case where the photosensitive layer is a single-layer-type photosensitive layer, the single-layer-type photosensitive layer can be formed by applying an application liquid containing the charge generating substance, the charge transport substance, and the binder resin, followed by drying.

In order to enhance durability of the electrophotographic photosensitive member, material designing for a surface layer (e.g., the charge transport layer) is important. Examples of the designing include use of a binder resin having high strength; in the case where the surface layer is the charge transport layer, control of a ratio between a charge transport substance which serves as a plasticizer and a binder resin; and use of a polymeric charge transport substance.

In order to further enhance durability of the electrophotographic photosensitive member, it is effective to provide a layer composed of a crosslinked organic polymer as a surface layer. Specifically, the charge transport layer itself can be composed of a crosslinked organic polymer as a surface layer. Furthermore, it is also possible to form a surface layer composed of a crosslinked organic polymer as a second charge transport layer or a protective layer on the charge transport layer (photosensitive layer). Compatibility between film strength and charge transporting ability is a characteristic required for the surface layer composed of a crosslinked organic polymer, and the layer is preferably formed using a charge transport substance and a polymerizable or crosslinkable monomer or oligomer. Furthermore, for the purpose of imparting charge transporting ability to the surface layer composed of a crosslinked organic polymer, conductive particles the resistance of which is controlled can also be used.

As the charge transport substance, any of known hole-transporting compounds and electron-transporting compounds can be used. Examples of the polymerizable or crosslinkable monomer or oligomer include chain polymerization type materials having a (meth)acryloyloxy group or a styrene group, and successive polymerization type materials having a hydroxyl group, an alkoxysilyl group, or an isocyanate group. In view of electrophotographic characteristics, versatility, material designing, and production stability, a system in which a hole-transporting compound and a chain polymerization type material are combined together is preferable. Furthermore, a system that cures a compound having in its molecule both a hole-transporting group and a chain polymerization type functional group, such as a (meth)acryloyloxy group, is particularly preferable.

Any means such as heat, light (e.g., ultraviolet light), or radiation (e.g., electron beam) can be used for curing and polymerization.

The thickness of the surface layer composed of a crosslinked organic polymer is preferably 0.1 μm or more and 30 μm or less, and more preferably 1 μm or more and 10 μm or less.

Furthermore, various additives can be added to each layer of the electrophotographic photosensitive member. Examples of the additives include anti-degradation agents, such as an antioxidant and an ultraviolet absorber; organic resin particles, such as fluorine atom-containing resin particles and acrylic resin particles; and inorganic particles of silica, titanium oxide, alumina, and the like.

[Process Cartridge and Electrophotographic Apparatus]

Figure 4:
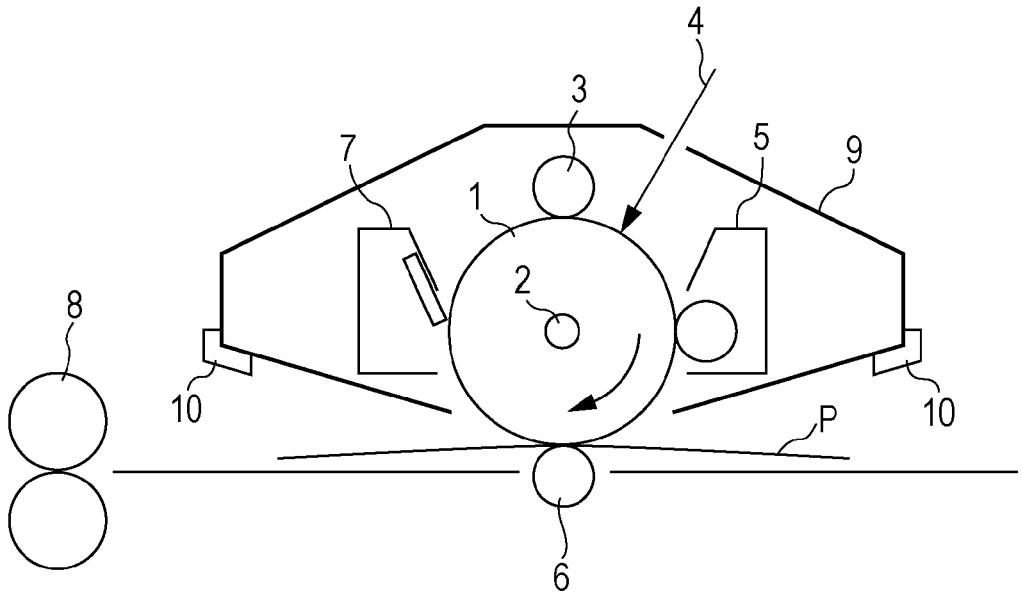
FIG. 4 is a view showing an example of a schematic structure of an electrophotographic apparatus provided with a process cartridge having an electrophotographic photosensitive member of the present invention.

FIG. 4 shows a schematic structure of an electrophotographic apparatus provided with a process cartridge having an electrophotographic photosensitive member of the present invention.

In FIG. 4, a cylindrical electrophotographic photosensitive member 1 of the present invention is rotated around an axis 2 in the direction indicated by an arrow at a predetermined peripheral speed (process speed). While being rotated, the peripheral surface of the electrophotographic photosensitive member 1 is uniformly charged to a predetermined, positive or negative potential by charging means 3 (primary charging means: for example, a charging roller or the like). Next, the peripheral surface receives exposure light (image exposure light) 4, which is reflected light from an original, output from exposing means (not shown), such as slit exposure or laser beam scanning exposure, and intensity-modified according to a time-series electrical digital image signal of target image information.

Thus, an electrostatic latent image corresponding to the target image information is sequentially formed on the peripheral surface of the electrophotographic photosensitive member 1.

The electrostatic latent image formed on the peripheral surface of the electrophotographic photosensitive member 1 is developed with toner which is contained in a developer in developing means 5, by a normal or reversal developing method, to be a toner image. Next, the toner image formed and carried on the peripheral surface of the electrophotographic photosensitive member 1 is sequentially transferred onto a transfer medium by a transferring bias from transferring means (e.g., a transfer roller) 6. In this process, the transfer medium P is fed from transfer medium feeding means (not shown) into a portion (contact portion) between the electrophotographic photosensitive member 1 and the transferring means 6 in synchronization with the rotation of the electrophotographic photosensitive member 1. In addition, a bias voltage having a reverse polarity to the charge polarity of the toner is applied to the transferring means from a bias supply (not shown).

In the case where the transfer medium P on which the toner image has been transferred is a final transfer medium (paper, film, or the like), the transfer medium P is separated from the peripheral surface of the electrophotographic photosensitive member and conveyed to fixing means 8 where the toner image is subjected to a fixing process. After the fixing process, the transfer material is printed out as an image-formed matter (print or copy) to the outside of the electrophotographic apparatus. In the case where the transfer medium P is an intermediate transfer member, after a plurality of transfer steps (for example, a primary transfer step and a secondary transfer step), a fixing process is performed, and a final transfer medium is printed out.

Deposition, such as the developer (toner) remaining after transfer, on the peripheral surface of the electrophotographic photosensitive member 1, from which the toner image has been transferred to the transfer medium, is removed by cleaning means 7 provided with a cleaning blade so that the peripheral surface is cleaned. As the cleaning blade of the cleaning means 7, preferably, a cleaning blade composed of urethane is used. Furthermore, for the purpose of enhancing releasability, water repellency, hardness, and the like, use of a blade which is coated or surface-treated, or a blade to which a filler and the like are added is also effective. The cleaning blade can be brought into contact with (abutted against) the peripheral surface of the electrophotographic photosensitive member by known means. The linear pressure (contact pressure) of the cleaning blade to the peripheral surface of the electrophotographic photosensitive member is preferably 10 g/cm or more and 250 g/cm or less. Furthermore, the contact angle of the cleaning blade with respect to the peripheral surface of the electrophotographic photosensitive member is preferably 15° or more and 45° or less. The present invention is effective not only in the case where the contact pressure of the cleaning blade to the peripheral surface of the electrophotographic photosensitive member is large, but also in the case where the contact pressure is small.

Furthermore, the peripheral surface is de-charged by pre-exposure light (not shown) from pre-exposing means (not shown), and is then repeatedly used for image formation. In addition, as shown in FIG. 4, in the case where the charging means 3 is contact charging means using a charging roller or the like, pre-exposure is not necessarily required.

Furthermore, in the present invention, each of an irregularly shaped toner and a spherical toner is usable as the toner.

In the present invention, two or more of the components described above, i.e., the electrophotographic photosensitive member 1, the charging means 3, the developing means 5, the transferring means 6, the cleaning means 7, and the like, may be held in a container and integrally combined together to constitute a process cartridge. Furthermore, the process cartridge may be configured so as to be detachably mountable to the main body of an electrophotographic apparatus, such as a copying machine or a laser beam printer. In FIG. 4, the electrophotographic photosensitive member 1, the charging means 3, the developing means 5, and the cleaning means 7 are integrally supported to constitute a cartridge 9, which is detachably mountable to the main body of the electrophotographic apparatus by using guiding means 10, such as a rail, of the main body of the electrophotographic apparatus.

In the case where the electrophotographic apparatus is a copying machine or a printer, the exposure light 4 is reflected light or transmitted light from an original; or light irradiated by scanning with a laser beam according to signals, into which an original read by a sensor is converted, or driving of an LED array or a liquid-crystal shutter array.

The electrophotographic photosensitive member of the present invention can be generally applied to various electrophotographic apparatuses, such as electrophotographic copying machines, laser beam printers, LED printers, FAX machines, and liquid-crystal shutter printers. Furthermore, the electrophotographic photosensitive member of the present invention is widely applicable to devices, such as display, recording, near-print, plate making, and facsimile devices, to which electrophotographic techniques are applied.

EXAMPLES

The present invention will be described in more detail below on the basis of specific examples. In the examples, the term "part(s)" refers to "part(s) by mass".

Production Example of Electrophotographic Photosensitive Member A-1

[Fabrication of Electrophotographic Photosensitive Member Before Flat Portion/Groove Portion Shape is Formed on Peripheral Surface]

An aluminum cylinder having a diameter of 30 mm was used as a support (cylindrical support).

Next, an application liquid for a conductive layer was prepared by dispersing, with a ball mill for 20 hours, a solution composed of 60 parts of barium sulfate particles having a tin oxide coating layer (trade name: Pastran PC1, manufactured by Mitsui Mining & Smelting Co., Ltd.), 15 parts of titanium oxide (trade name: TITANIX JR, manufactured by Tayca Corporation), 43 parts of a resol-type phenol resin (trade name: Phenolite J-325, manufactured by Dainippon Ink and Chemicals, Inc., solid content: 70% by mass), 0.015 parts of silicone oil (trade name: SH28PA, manufactured by Toray Silicone Co., Ltd.), 3.6 parts of a silicone resin (trade name: Tospearl 120, manufactured by Toshiba Silicone Co., Ltd.), 50 parts of 2-methoxy-1-propanol, and 50 parts of methanol.

The application liquid for the conductive layer was applied onto the support by dip coating, and cured by heating at 140° C. for one hour. Thereby, a conductive layer with a thickness of 15 μm was formed.

Next, by dissolving 10 parts of a copolymerized nylon resin (trade name: AMILANCM8000, manufactured by Toray Industries, Inc.) and 30 parts of a methoxymethylated 6 nylon resin (trade name: Toresin EF-30T, manufactured by Teikoku Chemical Industries, Inc.) in a mixed solvent including 400 parts of methanol and 200 parts of n-butanol, an application liquid for an intermediate layer was prepared.

The application liquid for the intermediate layer was applied onto the conductive layer by dip coating, and dried at 100° C. for 30 minutes. Thereby, an intermediate layer with a thickness of 0.45 jam was formed.

Next, a solution composed of 20 parts of hydroxygallium phthalocyanine crystals (charge generating substance) with a crystal form having strong peaks at Bragg angles 2θ±0.2° of 7.4° and 28.2° in CuKα characteristic X-ray diffraction, 0.2 parts of a calixarene compound represented by structural formula (1) below:

(1)

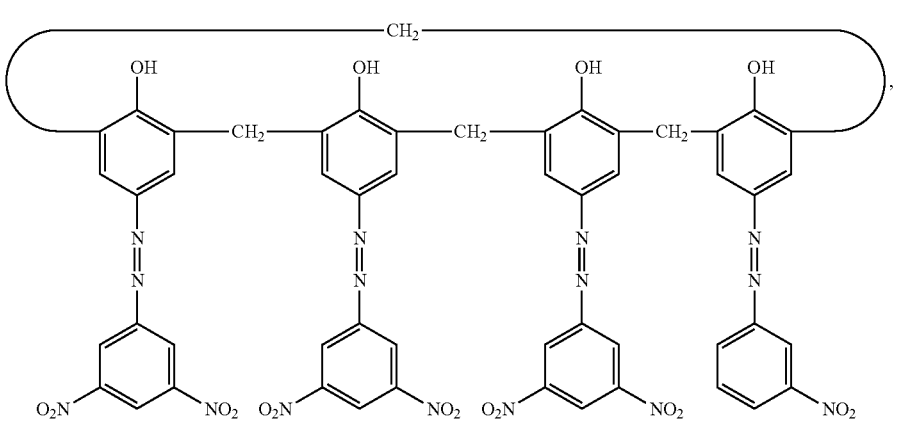

10 parts of polyvinyl butyral (trade name: S-LEC BX-1, manufactured by Sekisui Chemical Co., Ltd.), and 600 parts of cyclohexanone was dispersed with a sand mill using glass beads having a diameter of 1 mm for 4 hours, and then 700 parts of ethyl acetate was added to the resulting dispersion liquid. Thereby, an application liquid for a charge generation layer was prepared.

The application liquid for the charge generation layer was applied onto the intermediate layer by dip coating, and dried at 80° C. for 15 minutes. Thereby, a charge generation layer with a thickness of 0.17 μm was formed.

Next, by dissolving 70 parts of a compound (charge transport substance) represented by structural formula (2) below:

(2)

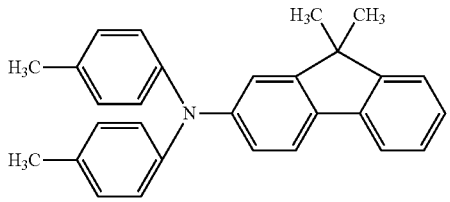

and 100 parts of a polycarbonate resin (bisphenol Z type polycarbonate resin, trade name: Iupilon Z400, manufactured by Mitsubishi Engineering-Plastics Corporation) were dissolved in a mixed solvent including 600 parts of monochlorobenzene and 200 parts of methylal, an application liquid for a charge transport layer was prepared.

The application liquid for the charge transport layer was applied onto the charge generation layer by dip coating, and dried at 100° C. for 30 minutes. Thereby, a charge transport layer with a thickness of 15 μm was formed.

Next, 100 parts of a hole-transporting compound represented by structural formula (3) below was added to a mixed solvent including 80 parts of 1,1,2,2,3,3,4-heptafluorocyclopentane (trade name: Zeorora H, manufactured by ZEON CORPORATION) and 80 parts of 1-propanol.

(3)

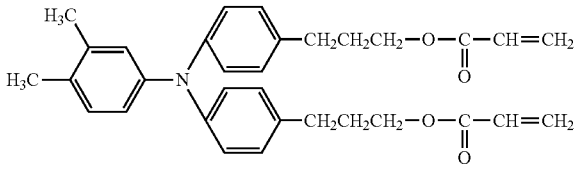

The resulting mixture was filtered through a Polyflon filter (trade name: PF-020, manufactured by ADVANTEC), and thereby an application liquid for a protective layer (second charge transport layer) was prepared.

The application liquid for the protective layer (second charge transport layer) was applied onto the charge transport layer, and then dried in air at 50° C. for 10 minutes. Then, electron beam irradiation was performed for 1.6 seconds, in nitrogen, under conditions of an accelerating voltage of 150 kV and a beam current of 3.0 mA while the support (body to be irradiated) was rotated at 200 rpm. Subsequently, in nitrogen, the temperature was raised from 25° C. to 125° C. over a period of 30 seconds to carry out a thermal curing reaction. In this case, the absorbed dose of the electron beams was measured and found to be 15 kGy. In addition, the oxygen concentration in the atmosphere in which the electron beam irradiation and thermal curing reaction were carried out was 15 ppm or less. The resulting product was naturally cooled to 25° C. in air, and then subjected to post-heat treatment in air at 100° C. for 30 minutes. Thereby, a protective layer (second charge transport layer) with a thickness of 5 μm was formed.

In such a manner, an electrophotographic photosensitive member before a flat portion/groove portion shape was formed on the peripheral surface thereof was obtained.

[Shape Transfer by Mold Pressure Contact]

Figure 5:
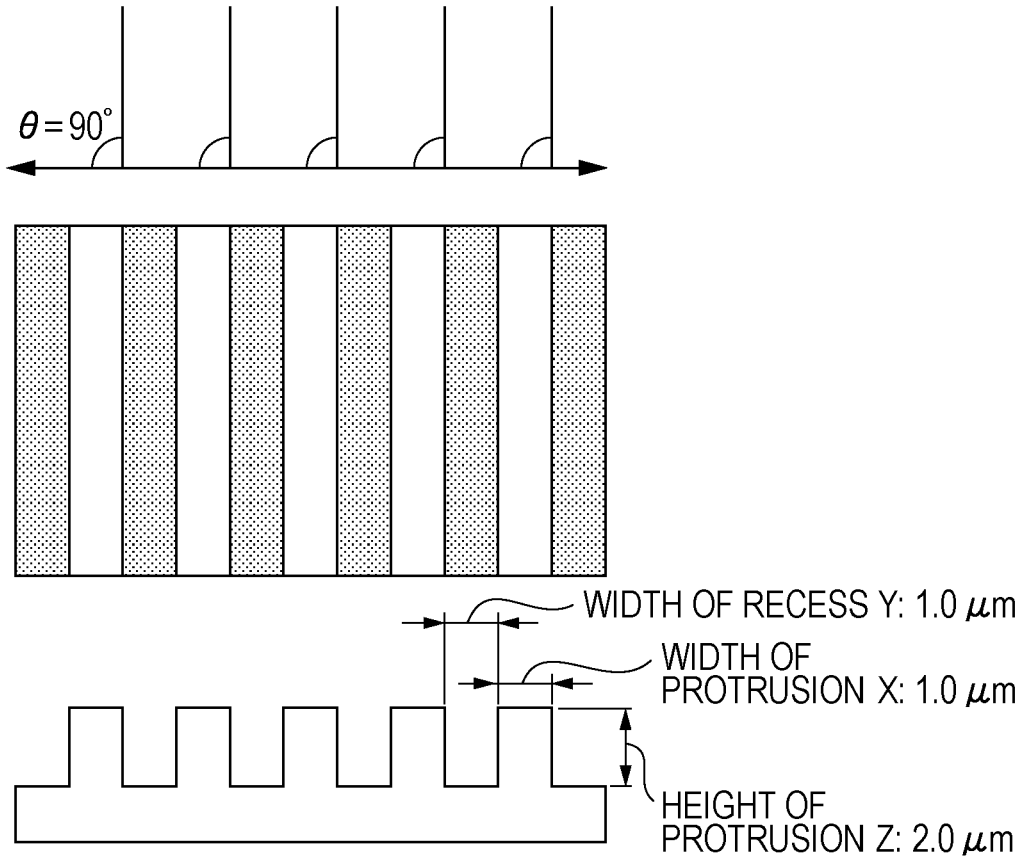
FIG. 5 is a view showing a shape of a mold.

The electrophotographic photosensitive member before a flat portion/groove portion shape was formed on the peripheral surface thereof (on which shape transfer was to be performed) was placed in a surface shape processing apparatus shown in FIG. 2. The material for the pressure member was stainless steel (SUS), and a heater for heating was placed inside the apparatus. As the mold, a mold composed of nickel with a thickness of 50 μm having a shape (width of protrusion X: 1.0 μm, width of recess Y: 1.0 μm, and height of protrusion Z: 2.0 μm) as shown in FIG. 5, was used. The mold was fixed on the pressure member such that the recesses of the mold were placed at an angle of 90° with respect to the axial direction of the electrophotographic photosensitive member, on which shape transfer was to be performed. A cylindrical holding member composed of SUS having substantially the same diameter as the inner diameter of the support was inserted into the inside of the support of the electrophotographic photosensitive member, on which shape transfer was to be performed. Using the apparatus having the configuration described above, a flat portion/groove portion shape was formed on the peripheral surface of the electrophotographic photosensitive member, on which shape transfer was to be performed, under conditions of a mold temperature of 140° C., a processing pressure of 10 MPa, and a processing speed of 20 mm/s.

In such a manner, an electrophotographic photosensitive member (cylindrical electrophotographic photosensitive member) having the flat portion/groove portion shape provided on the peripheral surface thereof was obtained. This electrophotographic photosensitive member is referred to as an "electrophotographic photosensitive member A-1".

[Observation of Peripheral Surface of Electrophotographic Photosensitive Member (Observation of Flat Portion/Groove Portion Shape)]

The peripheral surface of the resulting electrophotographic photosensitive member A-1 was observed under magnification with a laser microscope (trade name: VK-9500, manufactured by Keyence Corporation). As a result, it was found that, referring to FIG. 1, a flat portion/groove portion shape with a width e of the flat portion of 1.0 μm, a width w of the groove portion of 1.0 μm, and a depth d of the groove portion of 1.0 μm was formed on the peripheral surface of the electrophotographic photosensitive member A-1. Furthermore, it was found that the flat portions and the groove portions were formed at an angle of 90° with respect to the axial direction of the electrophotographic photosensitive member A-1. Furthermore, the average value $e_{Av}$ of the widths of the flat portions, the standard deviation $e_\sigma$ thereof, the average value $w_{Av}$ of the widths of the groove portions, the standard deviation $w_\sigma$ thereof, the average value $d_{Av}$ of the depths of the groove portions, the standard deviation $d_\sigma$ thereof, and the sum $e_{sum}$ (μm) of the widths e of the flat portions per each width of 100 μm in the axial direction of the peripheral surface of the electrophotographic photosensitive member were calculated as described above. The results thereof are shown in Table 1.

Production Example of Electrophotographic Photosensitive Members A-2 to A-9

Electrophotographic photosensitive members A-2 to A-9 were produced as in the production example of the electrophotographic photosensitive member A-1 except that the mold was changed to molds having shapes shown in Table 2, and the peripheral surfaces of the electrophotographic photosensitive members were observed. The results thereof are shown in Table 1.

Production Example of Electrophotographic Photosensitive Members A-10 and A-11

Electrophotographic photosensitive members A-10 and A-11 were produced as in the production example of the electrophotographic photosensitive member A-1 except that the mold during shape transfer was fixed on the pressure member such that the recesses of the mold were placed at an angle of 80° or 100° with respect to the axial direction of the electrophotographic photosensitive member, and the peripheral surfaces of the electrophotographic photosensitive members were observed. The results thereof are shown in Table 1.

Production Example of Electrophotographic Photosensitive Members A-12 to A-14

Figure 6:
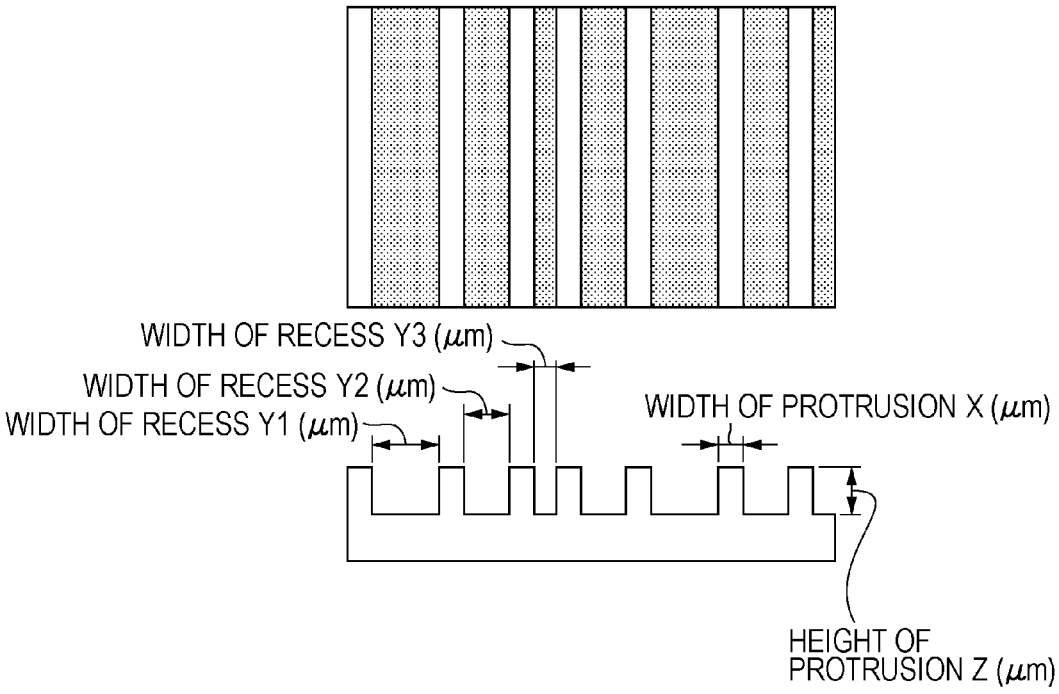
FIG. 6 is a view showing a shape of a mold.

Electrophotographic photosensitive members A-12 to A-14 were produced as in the production example of the electrophotographic photosensitive member A-1 except that the mold was changed to molds having shapes shown in FIG. 6 and Table 2, and the peripheral surfaces of the electrophotographic photosensitive members were observed. The results thereof are shown in Table 1.

Production Example of Electrophotographic Photosensitive Members A-15 and A-16

Figure 7:
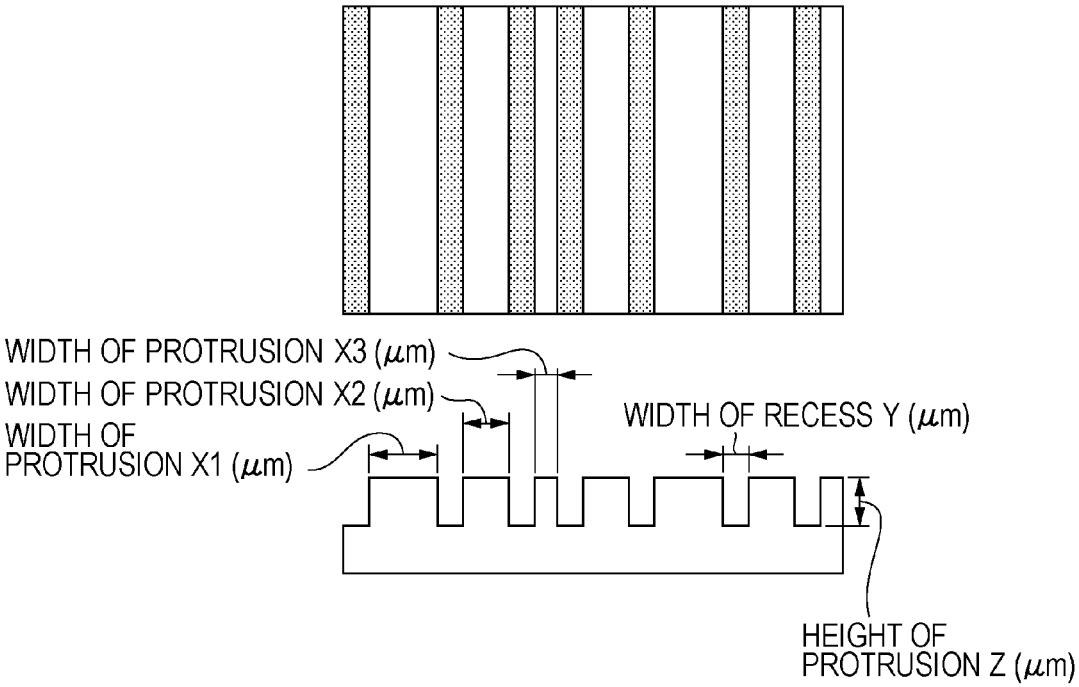
FIG. 7 is a view showing a shape of a mold.

Electrophotographic photosensitive members A-15 and A-16 were produced as in the production example of the electrophotographic photosensitive member A-1 except that the mold was changed to molds having shapes shown in FIG. 7 and Table 2, and the peripheral surfaces of the electrophotographic photosensitive members were observed. The results thereof are shown in Table 1.

Production Example of Electrophotographic Photosensitive Members A-17 and A-18

Figure 8:
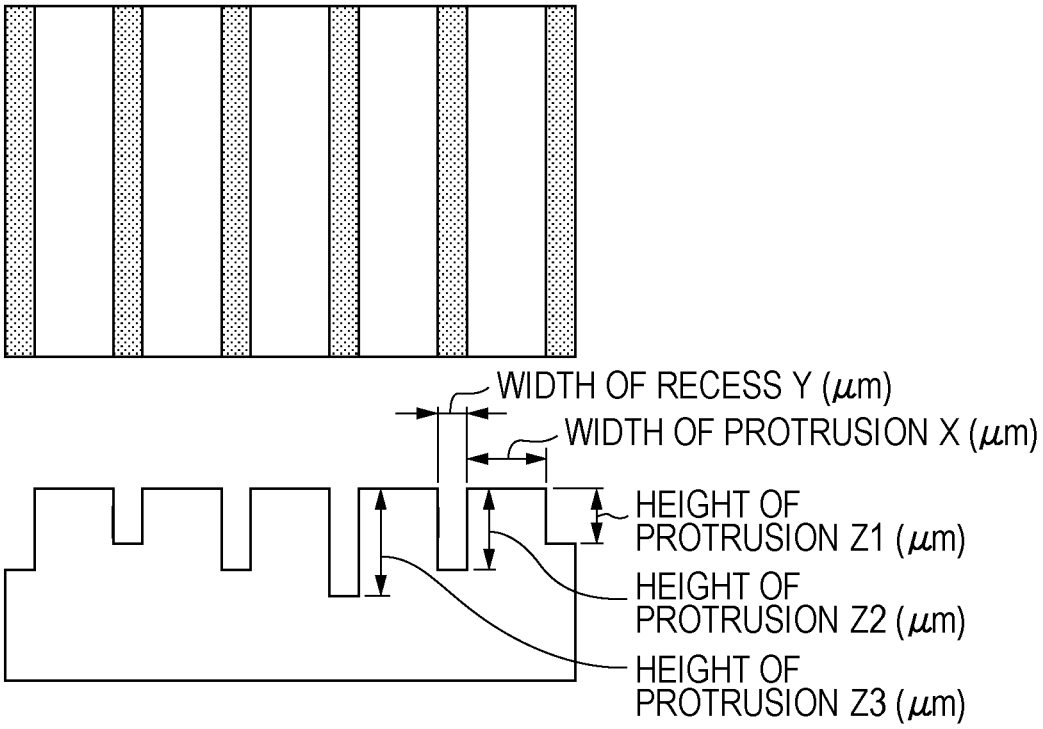
FIG. 8 is a view showing a shape of a mold.

Electrophotographic photosensitive members A-17 and A-18 were produced as in the production example of the electrophotographic photosensitive member A-1 except that the mold was changed to molds having shapes shown in FIG. 8 and Table 2, and the peripheral surfaces of the electrophotographic photosensitive members were observed. The results thereof are shown in Table 1.

Production Example of Electrophotographic Photosensitive Member A-19

An electrophotographic photosensitive member A-19 was produced as in the production example of the electrophotographic photosensitive member A-1 except that the mold was changed to a mold fabricated as described below. The peripheral surface of the resulting electrophotographic photosensitive member A-19 was observed, and it was found that flat portions with a width of 0.1 to 1.0 μm and groove portions with a width of 0.1 to 7.0 μm and a depth of 0.1 to 0.6 μm were randomly formed. The results thereof are shown in Table 1.

Fabrication of Mold

Using the application liquids used in the production example of the electrophotographic photosensitive member A-1, an intermediate layer with a thickness of 0.45 μm and a charge transport layer with a thickness of 15 μm were formed in that order on an aluminum cylinder with a diameter of 40 mm and a length of 360 mm (workpiece 1). Then, using an abrasive sheet C-3000 manufactured by Fujifilm Corporation, the peripheral surface of the workpiece 1 was ground to form grooves (grooves in the circumferential direction), at an angle of 90° with respect to the axial direction of the electrophotographic photosensitive member, on the peripheral surface of the charge transport layer of the workpiece 1. Furthermore, the peripheral surface of the charge transport layer of the workpiece 1 provided with the grooves was subjected to electroforming, and Ni at a thickness of 50 μm was deposited. Then, the deposited Ni was separated from the charge transport layer and used as a mold in this example. The mold was observed under a laser microscope, and it was found that the mold had a random groove shape having a width of protrusion X of 0.1 to 10.0 μm, a width of recess Y of 0.1 to 1.0 μm and a height of protrusion Z of 0.1 to 1.5 μm.

Production Example of Electrophotographic Photosensitive Member A-20

Figure 9:
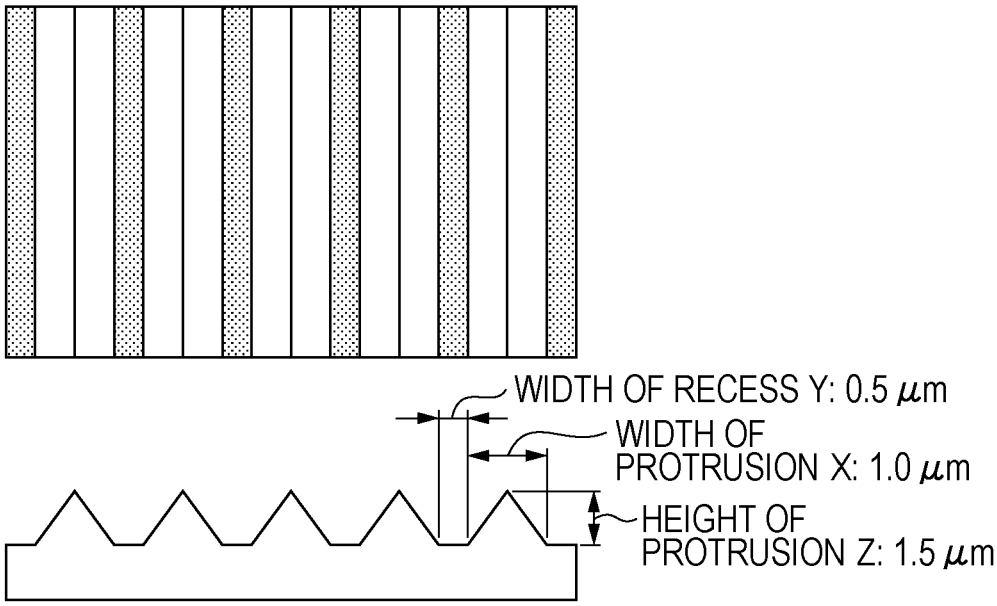
FIG. 9 is a view showing a shape of a mold.

An electrophotographic photosensitive member A-20 was produced as in the production example of the electrophotographic photosensitive member A-1 except that the mold was changed to a mold having a shape shown in FIG. 9 and Table 2, and the peripheral surface of the electrophotographic photosensitive member was observed. The results thereof are shown in Table 1.

Production Example of Electrophotographic Photosensitive Member A-21

Figure 10A:
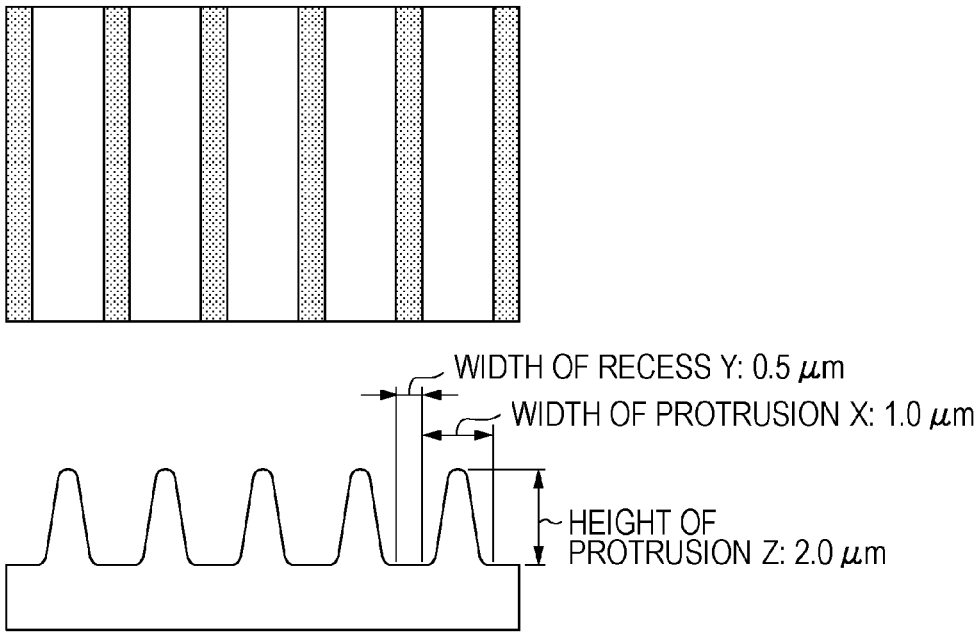
FIGS. 10A and 10B are views each showing a shape of a mold.

An electrophotographic photosensitive member A-21 was produced as in the production example of the electrophotographic photosensitive member A-1 except that the mold was changed to a mold having a shape shown in FIG. 10A and Table 2, and the peripheral surface of the electrophotographic photosensitive member was observed. The results thereof are shown in Table 1.

Production Example of Electrophotographic Photosensitive Member A-22

An electrophotographic photosensitive member A-22 was produced as in the production example of the electrophotographic photosensitive member A-1 except that the application liquid for the protective layer (second charge transport layer) was changed to an application liquid prepared as described below, and the peripheral surface of the electrophotographic photosensitive member was observed. The results thereof are shown in Table 1.

Preparation of Application Liquid for Protective Layer (Second Charge Transport Layer)

A fluorine atom-containing resin (trade name: GF-300, manufactured by Toagosei Co., Ltd.) (1.5 parts), as a dispersant, was dissolved in a mix solvent including 20 parts of 1,1,2,2,3,3,4-heptafluorocyclopentane (trade name: Zeorora H, manufactured by ZEON CORPORATION) and 20 parts of 1-propanol. As a lubricant, 30 parts of polytetrafluoroethylene resin particles (trade name: Rubron L-2, manufactured by Daikin Industries, Ltd.) was added to the resulting solution. Then, the resulting mixture was subjected to dispersion treatment four times with a high-pressure dispersing apparatus (trade name: Microfluidizer M-110EH, manufactured by Microfluidics U.S.A.) at a pressure of 600 kgf/cm$^2$, and further filtered through a Polyflon filter (trade name: PF-020, manufactured by ADVANTEC). Thereby, a lubricant-dispersed liquid was prepared. Then, 70 parts of the hole-transporting compound represented by structural formula (3) described above, 70 parts of 1,1,2,2,3,3,4-heptafluorocyclopentane, and 70 parts of 1-propanol were added to the lubricant-dispersed liquid. By filtering the resulting mixture through a Polyflon filter (trade name: PF-020, manufactured by ADVANTEC), an application liquid for a protective layer (second charge transport layer) was prepared.

Production Example of Electrophotographic Photosensitive Member A-23

An electrophotographic photosensitive member A-23 was produced as in the production example of the electrophotographic photosensitive member A-1 except that the application liquid for the protective layer (second charge transport layer) was changed to an application liquid prepared as described below, and curing by electron beam irradiation was changed to curing by heat at 140° C. for one hour, and the peripheral surface of the electrophotographic photosensitive member was observed. The results thereof are shown in Table 1.

Preparation of Application Liquid for Protective Layer (Second Charge Transport Layer)

100 Parts of a hole-transporting hydroxymethyl group-containing phenol compound represented by structural formula (4) below:

(4)

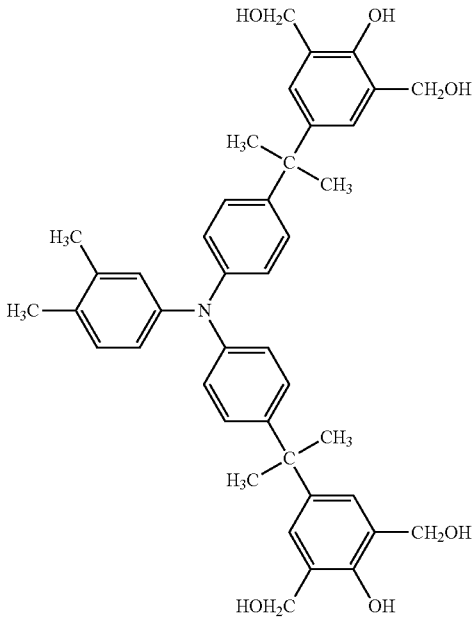

was dissolved in 150 parts of 1-propanol. The resulting solution was filtered through a Polyflon filter (trade name: PF-020, manufactured by ADVANTEC), and thereby an application liquid for a protective layer (second charge transport layer) was prepared.

Production Example of Electrophotographic Photosensitive Member A-24

An electrophotographic photosensitive member A-24 was produced as in the production example of the electrophotographic photosensitive member A-1 except that the diameter of the aluminum cylinder used was changed from 30 mm to 24 mm, and the peripheral surface of the electrophotographic photosensitive member was observed. The results thereof are shown in Table 1.

Production Example of Electrophotographic Photosensitive Members B-1 and B-2

Electrophotographic photosensitive members B-1 and B-2 were produced as in the production example of the electrophotographic photosensitive member A-1 except that the thickness of the charge transport layer was changed to 20 μm, and an electrophotographic photosensitive member which was not provided with a protective layer (second charge transport layer) was obtained, and that the mold was changed to a mold shown in FIG. 5 and Table 2, and the processing conditions were changed to a mold temperature of 120° C., a processing pressure of 8 MPa, and a processing speed of 20 mm/s. The peripheral surfaces of the electrophotographic photosensitive members were observed. The results thereof are shown in Table 1.

Production Example of Electrophotographic Photosensitive Member B-3

An electrophotographic photosensitive member B-3 was produced as in the production example of the electrophotographic photosensitive member B-1 except that the mold was changed to a mold shown in FIG. 6 and Table 2, and the peripheral surface of the electrophotographic photosensitive members was observed. The results thereof are shown in Table 1.

Production Example of Electrophotographic Photosensitive Member B-4

An electrophotographic photosensitive member B-4 was produced as in the production example of the electrophotographic photosensitive member B-1 except that the mold was changed to a mold fabricated as described below. The peripheral surface of the resulting electrophotographic photosensitive member B-4 was observed, and it was found that flat portions with a width of 0.1 to 1.0 μm and groove portions with a width of 0.1 to 5.0 μm and a depth of 0.1 to 0.6 μm were randomly formed. The results thereof are shown in Table 1.

Fabrication of Mold

Using the application liquids used in the production example of the electrophotographic photosensitive member A-1, an intermediate layer with a thickness of 0.45 μm and a charge transport layer with a thickness of 15 μm were formed in that order on an aluminum cylinder with a diameter of 40 mm and a length of 360 mm (workpiece 2). Then, using an abrasive sheet C-4000 manufactured by Fujifilm Corporation, the peripheral surface of the workpiece 2 was ground to form grooves (grooves in the circumferential direction), at an angle of 90° with respect to the axial direction of the electrophotographic photosensitive member, on the peripheral surface of the charge transport layer of the workpiece 2. Furthermore, the peripheral surface of the charge transport layer of the workpiece 2 provided with the grooves was subjected to electroforming, and Ni at a thickness of 50 μm was deposited. Then, the deposited Ni was separated from the charge transport layer and used as a mold in this example. The mold was observed under a laser microscope, and it was found that the mold had a random groove shape having a width of protrusion X of 0.1 to 5.0 μm, a width of recess Y of 0.1 to 1.0 μm and a height of protrusion Z of 0.1 to 0.6

Production Example of Electrophotographic Photosensitive Members B-5 to B-8

Electrophotographic photosensitive members B-5 to B-8 were produced as in the production example of the electrophotographic photosensitive members B-1 to B-4, respectively, except that the polycarbonate resin used for the charge transport layer was changed to a polyarylate resin (weight average molecular weight: 130000, tere:iso=1:1 (molar ratio) in phthalic acid skeletons) having a repeating structural unit represented by structural formula (5) below.

(5)

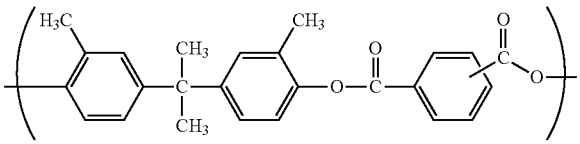

The peripheral surfaces of the electrophotographic photosensitive members were observed. The results thereof are shown in Table 1.

Production Example of Electrophotographic Photosensitive Member B-9

An electrophotographic photosensitive member B-9 was produced as in the production example of the electrophotographic photosensitive member B-1 except that the diameter of the aluminum cylinder used was changed from 30 mm to 24 mm, and the peripheral surface of the electrophotographic photosensitive member was observed. The results thereof are shown in Table 1.

Production Example of Electrophotographic Photosensitive Member C-1

An electrophotographic photosensitive member C-1 was produced as in the production example of the electrophotographic photosensitive member A-1 except that shape transfer by mold pressure contact was not performed.

Production Example of Electrophotographic Photosensitive Member C-2

An electrophotographic photosensitive member C-2 was produced as in the production example of the electrophotographic photosensitive member A-1 except that the mold was changed to a mold having a shape shown in FIG. 5 and Table 2, and the peripheral surface of the electrophotographic photosensitive member was observed. The results thereof are shown in Table 1.

Production Example of Electrophotographic Photosensitive Member C-3

Figure 10B:
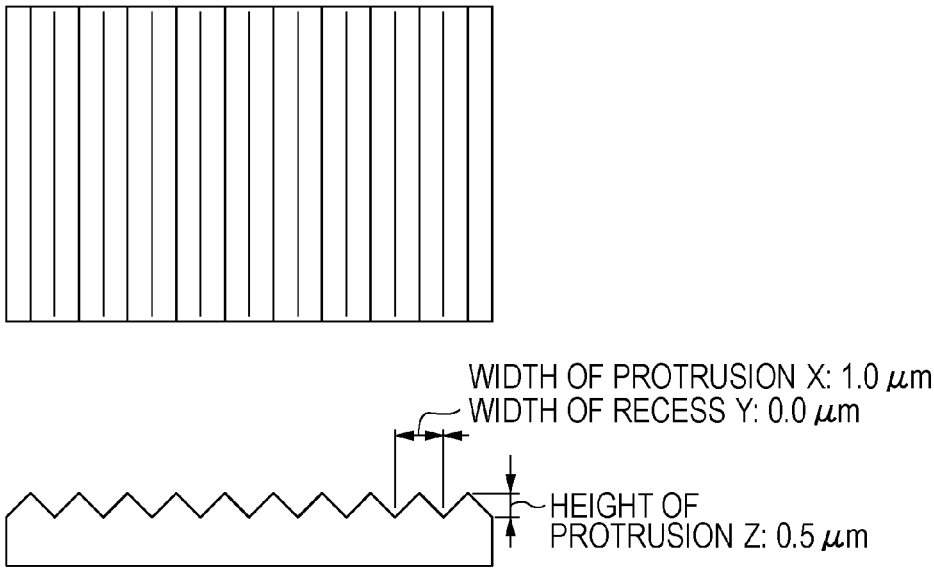

An electrophotographic photosensitive member C-3 was produced as in the production example of the electrophotographic photosensitive member A-1 except that the mold was changed to a mold shown in FIG. 10B and Table 2, and the processing conditions were changed to a mold temperature of 180° C., a processing pressure of 15 MPa, and a processing speed of 5 mm/s, and the peripheral surface of the electrophotographic photosensitive member was observed. The results thereof are shown in Table 1.

Production Example of Electrophotographic Photosensitive Member C-4

An electrophotographic photosensitive member C-4 was produced as in the production example of the electrophotographic photosensitive member A-1 except that the mold was changed to a mold shown in FIG. 6 and Table 2, and the peripheral surface of the electrophotographic photosensitive members was observed. The results thereof are shown in Table 1.

Production Example of Electrophotographic Photosensitive Member C-5

An electrophotographic photosensitive member C-5 was produced as in the production example of the electrophotographic photosensitive member A-19 except that the abrasive sheet C-4000 used in the fabrication of the mold was changed to C-2000. The peripheral surface of the resulting electrophotographic photosensitive member C-5 was observed, and it was found that flat portions with a width of 0.1 to 2.5 μm and groove portions with a width of 0.5 to 20.0 μm and a depth of 0.1 to 1.5 μm were randomly formed. The results thereof are shown in Table 1.

Production Example of Electrophotographic Photosensitive Member C-6

An electrophotographic photosensitive member C-6 was produced as in the production example of the electrophotographic photosensitive member A-1 except that formation of the flat portion/groove portion shape by mold pressure contact was changed to formation of the flat portion/groove portion shape by an abrasive tape described below. The peripheral surface of the resulting electrophotographic photosensitive member C-6 was observed, and it was found that flat portions with a width of 0.1 to 2.5 μm and groove portions with a width of 0.5 to 20.0 μm and a depth of 0.1 to 1.7 μm were randomly formed. The results thereof are shown in Table 1.

Formation of Flat Portion/Groove Portion Shape by Abrasive Tape

Using an abrasive sheet C-2000 manufactured by Fujifilm Corporation, the peripheral surface of the electrophotographic photosensitive member was ground to form grooves, in the circumferential direction, on the peripheral surface of the electrophotographic photosensitive member.

Production Example of Electrophotographic Photosensitive Member D-1

An electrophotographic photosensitive member D-1 was produced as in the production example of the electrophotographic photosensitive member B-1 except that shape transfer by mold pressure contact was not performed.

Production Example of Electrophotographic Photosensitive Member D-2

An electrophotographic photosensitive member D-2 was produced as in the production, example of the electrophotographic photosensitive member B-1 except that the mold was changed to a mold having a shape shown in FIG. 5 and Table 2, and the peripheral surface of the electrophotographic photosensitive member was observed. The results thereof are shown in Table 1.

Production Example of Electrophotographic Photosensitive Member D-3

An electrophotographic photosensitive member D-3 was produced as in the production example of the electrophotographic photosensitive member B-1 except that the mold was changed to a mold having a shape shown in FIG. 10B and Table 2, and the peripheral surface of the electrophotographic photosensitive member was observed. The results thereof are shown in Table 1.

Production Example of Electrophotographic Photosensitive Member D-4

An electrophotographic photosensitive member D-4 was produced as in the production example of the electrophotographic photosensitive member B-1 except that the mold was changed to a mold having a shape shown in FIG. 6 and Table 2, and the peripheral surface of the electrophotographic photosensitive member was observed. The results thereof are shown in Table 1.

Production Example of Electrophotographic Photosensitive Member D-5

An electrophotographic photosensitive member D-5 was produced as in the production example of the electrophotographic photosensitive member B-1 except that formation of the flat portion/groove portion shape by mold pressure contact was changed to formation of the flat portion/groove portion shape by an abrasive tape described below. The peripheral surface of the resulting electrophotographic photosensitive member D-5 was observed, and it was found that flat portions with a width of 0.1 to 3.0 μm and groove portions with a width of 0.5 to 25.0 μm and a depth of 0.1 to 1.9 μm were randomly formed. The results thereof are shown in Table 1.

Formation of Flat Portion/Groove Portion Shape by Abrasive Tape

Using a lapping film (mesh number: 3000) manufactured by Sumitomo 3M Limited, the peripheral surface of the electrophotographic photosensitive member was ground to form grooves, in the circumferential direction, on the peripheral surface of the electrophotographic photosensitive member.

Production Example of Electrophotographic Photosensitive Member D-6

An electrophotographic photosensitive member D-6 was produced as in the production example of the electrophotographic photosensitive member B-5 except that shape transfer by mold pressure contact was not performed.

Production Example of Electrophotographic Photosensitive Member D-7

An electrophotographic photosensitive member D-7 was produced as in the production example of the electrophotographic photosensitive member B-5 except that the mold was changed to a mold having a shape shown in FIG. 5 and Table 2, and the peripheral surface of the electrophotographic photosensitive member was observed. The results thereof are shown in Table 1.

Production Example of Electrophotographic Photosensitive Member D-8

An electrophotographic photosensitive member D-8 was produced as in the production example of the electrophotographic photosensitive member B-5 except that the mold was changed to a mold having a shape shown in FIG. 10B and Table 2, and the peripheral surface of the electrophotographic photosensitive member was observed. The results thereof are shown in Table 1.

Production Example of Electrophotographic Photosensitive Member D-9

An electrophotographic photosensitive member D-9 was produced as in the production example of the electrophotographic photosensitive member B-5 except that the mold was changed to a mold having a shape shown in FIG. 6 and Table 2, and the peripheral surface of the electrophotographic photosensitive member was observed. The results thereof are shown in Table 1.

Production Example of Electrophotographic Photosensitive Member D-10

An electrophotographic photosensitive member D-10 was produced as in the production example of the electrophotographic photosensitive member B-5 except that formation of the flat portion/groove portion shape by mold pressure contact was changed to formation of the flat portion/groove portion shape by an abrasive tape described below. The peripheral surface of the resulting electrophotographic photosensitive member D-10 was observed, and it was found that flat portions with a width of 0.1 to 3.5 μm and groove portions with a width of 0.8 to 20.0 μm and a depth of 0.1 to 1.4 μm were randomly formed. The results thereof are shown in Table 1.

Formation of Flat Portion/Groove Portion Shape by Abrasive Tape

Using a lapping film (mesh number: 3000) manufactured by Sumitomo 3M Limited, the peripheral surface of the electrophotographic photosensitive member was ground to form grooves, in the circumferential direction, on the peripheral surface of the electrophotographic photosensitive member.

TABLE 1

| Electro-photographic photosensitive | Width of flat portion (μm) | | | Width of groove portion (μm) | | | Depth of groove portion (μm) | | | Sum of widths of flat portions (μm) | Angle (° C.) |
|---|---|---|---|---|---|---|---|---|---|---|---|
| member | e | $e_{Av}$ | $e_\sigma/e_{Av}$ | W | $W_{Av}$ | $W_\sigma/W_{Av}$ | d | $d_{Av}$ | $d_\sigma/d_{Av}$ | $e_{Sum}$ | θ |
| A-1 | 1.0 for all | 1.0 | 0 | 1.0 for all | 1.0 | 0 | 1.0 for all | 1.0 | 0 | 50 | 90 |
| A-2 | 5.0 for all | 5.0 | 0 | 5.0 for all | 5.0 | 0 | 1.0 for all | 1.0 | 0 | 50 | 90 |
| A-3 | 10.0 for all | 10.0 | 0 | 10.0 for all | 10.0 | 0 | 1.0 for all | 1.0 | 0 | 50 | 90 |

TABLE 1-continued

| Electro-photographic photosensitive | Width of flat portion (μm) | | | Width of groove portion (μm) | | | Depth of groove portion (μm) | | | Sum of widths of flat portions (μm) | Angle (° C.) |
|---|---|---|---|---|---|---|---|---|---|---|---|
| member | e | $e_{Av}$ | $e_\sigma/e_{Av}$ | W | $W_{Av}$ | $W_\sigma/W_{Av}$ | d | $d_{Av}$ | $d_\sigma/d_{Av}$ | $e_{Sum}$ | θ |
| A-4 | 25.0 for all | 25.0 | 0 | 25.0 for all | 25.0 | 0 | 3.0 for all | 3.0 | 0 | 50 | 90 |
| A-5 | 0.1 for all | 0.1 | 0 | 0.1 for all | 0.1 | 0 | 0.1 for all | 0.1 | 0 | 50 | 90 |
| A-6 | 0.5 for all | 0.5 | 0 | 1.5 for all | 1.5 | 0 | 1.0 for all | 1.0 | 0 | 25 | 90 |
| A-7 | 1.0 for all | 1.0 | 0 | 9.0 for all | 9.0 | 0 | 1.0 for all | 1.0 | 0 | 10 | 90 |
| A-8 | 0.5 for all | 0.5 | 0 | 9.5 for all | 9.5 | 0 | 1.0 for all | 1.0 | 0 | 5 | 90 |
| A-9 | 15.0 for all | 15.0 | 0 | 5.0 for all | 5.0 | 0 | 1.0 for all | 1.0 | 0 | 75 | 90 |
| A-10 | 1.0 for all | 1.0 | 0 | 1.0 for all | 1.0 | 0 | 1.0 for all | 1.0 | 0 | 50 | 80 |
| A-11 | 1.0 for all | 1.0 | 0 | 1.0 for all | 1.0 | 0 | 1.0 for all | 1.0 | 0 | 50 | 100 |
| A-12 | 2.9, 3.0, or 3.1 | 3.0 | 0.03 | 5.0 for all | 5.0 | 0 | 1.0 for all | 1.0 | 0 | 38 | 90 |
| A-13 | 2.7, 3.0, or 3.3 | 3.0 | 0.08 | 5.0 for all | 5.0 | 0 | 1.0 for all | 1.0 | 0 | 38 | 90 |
| A-14 | 2.0, 3.0, or 4.0 | 3.0 | 0.27 | 5.0 for all | 5.0 | 0 | 1.0 for all | 1.0 | 0 | 38 | 90 |
| A-15 | 3.0 for all | 3.0 | 0 | 2.7, 3.0, or 3.3 | 3.0 | 0.08 | 1.0 for all | 1.0 | 0 | 50 | 90 |
| A-16 | 3.0 for all | 3.0 | 0 | 1.0, 3.0, or 5.0 | 3.0 | 0.54 | 1.0 for all | 1.0 | 0 | 50 | 90 |
| A-17 | 1.0 for all | 1.0 | 0 | 1.0 for all | 1.0 | 0 | 0.9, 1.0, or 1.1 | 1.0 | 0.08 | 50 | 90 |
| A-18 | 1.0 for all | 1.0 | 0 | 1.0 for all | 1.0 | 0 | 0.4, 1.0, or 1.6 | 1.0 | 0.48 | 50 | 90 |
| A-19 | Random in the range of 0.1 to 1.0 μm | 0.3 | 0.46 | Random in the range of 0.1 to 7.0 μm | 1.7 | 0.41 | Random in the range of 0.1 to 0.6 μm | 0.2 | 0.48 | 5 | 90 |
| A-20 | 0.8 for all | 0.8 | 0 | 0.8 for all | 0.8 | 0 | 0.5 for all | 0.5 | 0 | 50 | 90 |
| A-21 | 0.8 for all | 0.8 | 0 | 0.8 for all | 0.8 | 0 | 1.0 for all | 1.0 | 0 | 50 | 90 |
| A-22 | 1.0 for all | 1.0 | 0 | 1.0 for all | 1.0 | 0 | 1.0 for all | 1.0 | 0 | 50 | 90 |
| A-23 | 1.0 for all | 1.0 | 0 | 1.0 for all | 1.0 | 0 | 1.0 for all | 1.0 | 0 | 50 | 90 |
| A-24 | 1.0 for all | 1.0 | 0 | 1.0 for all | 1.0 | 0 | 1.0 for all | 1.0 | 0 | 50 | 90 |
| B-1 | 1.0 for all | 1.0 | 0 | 1.0 for all | 1.0 | 0 | 1.0 for all | 1.0 | 0 | 50 | 90 |
| B-2 | 1.0 for all | 1.0 | 0 | 9.0 for all | 9.0 | 0 | 1.0 for all | 1.0 | 0 | 10 | 90 |
| B-3 | 2.7, 3.0, or 3.3 | 3.0 | 0.08 | 5.0 for all | 5.0 | 0 | 1.0 for all | 1.0 | 0 | 38 | 90 |
| B-4 | Random in the range of 0.1 to 1.0 μm | 0.3 | 0.41 | Random in the range of 0.1 to 5.0 μm | 1.2 | 0.42 | Random in the range of 0.1 to 0.6 μm | 0.2 | 0.42 | 5 | 90 |
| B-5 | 1.0 for all | 1.0 | 0 | 1.0 for all | 1.0 | 0 | 1.0 for all | 1.0 | 0 | 50 | 90 |
| B-6 | 1.0 for all | 1.0 | 0 | 9.0 for all | 9.0 | 0 | 1.0 for all | 1.0 | 0 | 10 | 90 |
| B-7 | 2.7, 3.0, or 3.3 | 3.0 | 0.08 | 5.0 for all | 5.0 | 0 | 1.0 for all | 1.0 | 0 | 38 | 90 |
| B-8 | Random in the range of 0.1 to 1.0 μm | 0.3 | 0.41 | Random in the range of 0.1 to 5.0 μm | 1.2 | 0.42 | Random in the range of 0.1 to 0.6 μm | 0.2 | 0.42 | 5 | 90 |
| B-9 | 1.0 for all | 1.0 | 0 | 1.0 for all | 1.0 | 0 | 1.0 for all | 1.0 | 0 | 50 | 90 |
| C-1 | — | — | — | — | — | — | — | — | — | 100 | — |
| C-2 | 9.0 for all | 9.0 | 0 | 1.0 for all | 1.0 | 0 | 1.0 for all | 1.0 | 0 | 90 | 90 |
| C-3 | No flat portions | — | — | 1.0 for all | 1.0 | 0 | 0.5 for all | 0.5 | 0 | — | 90 |
| C-4 | 1.0, 3.0, or 5.0 | 3.0 | 0.54 | 5.0 for all | 5.0 | 0 | 1.0 for all | 1.0 | 0 | 38 | 90 |
| C-5 | Random in the range of 0.1 to 2.5 μm | 0.5 | 0.62 | Random in the range of 0.5 to 20.0 μm | 1.5 | 0.60 | Random in the range of 0.1 to 1.5 μm | 0.6 | 0.36 | 5 | 90 |
| C-6 | Random in the range of 0.1 to 2.5 μm | 0.6 | 0.61 | Random in the range of 0.5 to 20.0 μm | 1.5 | 0.62 | Random in the range of 0.1 to 1.7 μm | 0.8 | 0.48 | 5 | 90 |
| D-1 | — | — | — | — | — | — | — | — | — | 100 | — |
| D-2 | 9.0 for all | 9.0 | 0 | 1.0 for all | 1.0 | 0 | 1.0 for all | 1.0 | 0 | 90 | 90 |
| D-3 | No flat portions | — | — | 1.0 for all | 1.0 | 0 | 1.0 for all | 1.0 | 0 | — | 90 |
| D-4 | 1.0, 3.0, or 5.0 | 3.0 | 0.54 | 5.0 for all | 5.0 | 0 | 1.0 for all | 1.0 | 0 | 38 | 90 |
| D-5 | Random in the range of 0.1 to 3.0 μm | 0.8 | 0.67 | Random in the range of 0.5 to 25.0 μm | 3.0 | 0.63 | Random in the range of 0.1 to 1.9 μm | 0.9 | 0.48 | 5 | 90 |
| D-6 | — | — | — | — | — | — | — | — | — | 100 | — |
| D-7 | 9.0 for all | 9.0 | 0 | 1.0 for all | 1.0 | 0 | 1.0 for all | 1.0 | 0 | 90 | 90 |
| D-8 | No flat portions | — | — | 1.0 for all | 1.0 | 0 | 1.0 for all | 1.0 | 0 | — | 90 |
| D-9 | 1.0, 3.0, or 5.0 | 3.0 | 0.54 | 5.0 for all | 5.0 | 0 | 1.0 for all | 1.0 | 0 | 38 | 90 |
| D-10 | Random in the range of 0.1 to 3.5 μm | 0.9 | 0.63 | Random in the range of 0.8 to 20.0 μm | 2.3 | 0.62 | Random in the range of 0.1 to 1.4 μm | 0.6 | 0.48 | 5 | 90 |

TABLE 2

| Electro-photographic photo-sensitive member | Mold drawing | Width of protrusion X(μm) | Width of recess Y(μm) | Depth of recess Z(μm) | Angle θ(°) |
|---|---|---|---|---|---|
| A-1 | FIG. 5 | 1.0 | 1.0 | 2.0 | 90 |
| A-2 | FIG. 5 | 5.0 | 5.0 | 2.0 | 90 |
| A-3 | FIG. 5 | 10.0 | 10.0 | 2.0 | 90 |
| A-4 | FIG. 5 | 25.0 | 25.0 | 6.0 | 90 |
| A-5 | FIG. 5 | 0.1 | 0.1 | 0.2 | 90 |
| A-6 | FIG. 5 | 1.5 | 0.5 | 2.0 | 90 |
| A-7 | FIG. 5 | 9.0 | 1.0 | 2.0 | 90 |
| A-8 | FIG. 5 | 9.5 | 0.5 | 2.0 | 90 |
| A-9 | FIG. 5 | 5.0 | 15.0 | 2.0 | 90 |
| A-10 | FIG. 5 | 1.0 | 1.0 | 2.0 | 100 |
| A-11 | FIG. 5 | 1.0 | 1.0 | 2.0 | 80 |
| A-12 | FIG. 6 | 5.0 | Y1: 3.1, Y2: 3.0, Y3: 2.9 | 2.0 | 90 |
| A-13 | FIG. 6 | 5.0 | Y1: 3.3, Y2: 3.0, Y3: 2.7 | 2.0 | 90 |
| A-14 | FIG. 6 | 5.0 | Y1: 4.0, Y2: 3.0, Y3: 2.0 | 2.0 | 90 |
| A-15 | FIG. 7 | X1: 3.3, X2: 3.0, X3: 2.7 | 3.0 | 2.0 | 90 |
| A-16 | FIG. 7 | X1: 5.0, X2: 3.0, X3: 1.0 | 3.0 | 2.0 | 90 |
| A-17 | FIG. 8 | 1.0 | 1.0 | Z1: 2.2, Z2: 2.0, Z3: 1.8 | 90 |
| A-18 | FIG. 8 | 1.0 | 1.0 | Z1: 3.2, Z2: 2.0, Z3: 0.8 | 90 |
| A-19 | — | 0.1 to 10.0 | 0.1 to 1.0 | 0.1 to 1.5 | 90 |
| A-20 | FIG. 9 | 1.0 | 0.5 | 1.5 | 90 |
| A-21 | FIG. 10(a) | 1.0 | 0.5 | 2.0 | 90 |
| A-22 | FIG. 5 | 1.0 | 1.0 | 2.0 | 90 |
| A-23 | FIG. 5 | 1.0 | 1.0 | 2.0 | 90 |
| A-24 | FIG. 5 | 1.0 | 1.0 | 2.0 | 90 |
| B-1 | FIG. 5 | 1.0 | 1.0 | 1.0 | 90 |
| B-2 | FIG. 5 | 9.0 | 1.0 | 1.0 | 90 |
| B-3 | FIG. 6 | 5.0 | Y1: 3.3, Y2: 3.0, Y3: 2.7 | 1.0 | 90 |
| B-4 | — | 0.1 to 5.0 | 0.1 to 1.0 | 0.1 to 0.6 | 90 |
| B-5 | FIG. 5 | 1.0 | 1.0 | 1.0 | 90 |
| B-6 | FIG. 5 | 9.0 | 1.0 | 1.0 | 90 |
| B-7 | FIG. 6 | 5.0 | Y1: 3.3, Y2: 3.0, Y3: 2.7 | 1.0 | 90 |
| B-8 | — | 0.1 to 5.0 | 0.1 to 1.0 | 0.1 to 0.6 | 90 |
| C-1 | — | — | — | — | — |
| C-2 | FIG. 5 | 1.0 | 9.0 | 2.0 | 90 |
| C-3 | FIG. 10(b) | 1.0 | 0.0 | 0.5 | 90 |
| C-4 | FIG. 6 | 5.0 | Y1: 5.0, Y2: 3.0, Y3: 1.0 | 2.0 | 90 |
| C-5 | — | 0.5 to 20.0 | 0.1 to 2.5 | 0.1 to 3.5 | 90 |
| C-6 | — | — | — | — | 90 |
| D-1 | — | — | — | — | — |
| D-2 | FIG. 5 | 1.0 | 9.0 | 1.0 | 90 |
| D-3 | FIG. 10(b) | 1.0 | 0.0 | 1.0 | 90 |
| D-4 | FIG. 6 | 5.0 | Y1: 5.0, Y2: 3.0, Y3: 1.0 | 1.0 | 90 |
| D-5 | — | — | — | — | 90 |
| D-6 | — | — | — | — | — |
| D-7 | FIG. 5 | 1.0 | 9.0 | 1.0 | 90 |
| D-8 | FIG. 10(b) | 1.0 | 0.0 | 1.0 | 90 |
| D-9 | FIG. 6 | 5.0 | Y1: 5.0, Y2: 3.0, Y3: 1.0 | 1.0 | 90 |
| D-10 | — | — | — | — | 90 |

Initial Evaluation of Electrophotographic Photosensitive Member

Example 1

The electrophotographic photosensitive member A-1 was mounted on a cyan station of a modified device of an electrophotographic copying machine (trade name: iRC3580) manufactured by CANON KABUSHIKI KAISHA, as an evaluation device, and testing and evaluation were performed as described below.

First, conditions for potential were set so that the dark-area potential (Vd) was −700 V and the light-area potential (Vl) was −200 V in an environment of 23° C./50% RH, and the initial potential of the electrophotographic photosensitive member was adjusted.

Next, a cleaning blade made of polyurethane rubber was set at a contact angle of 25° with respect to the peripheral surface of the electrophotographic photosensitive member. Furthermore, the linear pressure (contact pressure) to the peripheral surface of the electrophotographic photosensitive member was set at 15 g/cm, which was about half the value normally set.

Then, an A4 landscape-oriented half-tone image was printed on 10 sheets continuously, and a solid white image was printed on 50 sheets. Initial image defects due to inadequate cleaning were evaluated as described below. The results thereof are shown in Table 3.

A: No image defects due to occurrence of slip-through of toner caused by inadequate cleaning (image defects due to slip-through) are observed in the half-tone images and the solid white images.

B: No image defects due to slip-through occur in the half-tone images, but extremely slight image defects due to slip-through occur on latter part of the solid white images.

C: No image defects due to slip-through occur in the half-tone images, but extremely slight image defects due to slip-through occur on the solid white images from the first part.

D: Image defects due to slip-through occur in the half-tone images and the solid white images.

Furthermore, in each of environments of 15° C./10% RH and 30° C./80% RH, initial image defects due to inadequate cleaning were evaluated. The results thereof are shown in Table 3.

Furthermore, image formation (one dot-one space) was performed at an output resolution of 600 dpi, and the toner image formed on the intermediate transfer member before being transferred to paper was observed under magnification (100 times) with an optical microscope. Dot reproducibility was evaluated as follows. The results thereof are shown in Table 3.

A: Good reproducibility; no disturbance, scattering, or hollow defects are observed in dots.

B: No scattering or hollow defects occur, although slight disturbance of dots due to flowing of toner is observed.

C: Slight hollow defects due to nonuniform transferability in dots occur.

D: Slight disturbance of dots due to flowing of toner is observed; and slight hollow defects due to nonuniform transferability in dots occur.

E: Poor reproducibility; spreading of dots due to flowing of toner is observed.

Examples 2 to 31

Evaluation was performed as in Example 1 except that the electrophotographic photosensitive member to be evaluated was changed to the electrophotographic photosensitive members shown in Table 3. The results thereof are shown in Table 3.

Example 32

Evaluation was performed as in Example 1, except that the evaluation device was changed to a modified device of a laser beam printer LBP-2510 manufactured by CANON KABUSHIKI KAISHA, and the electrophotographic photosensitive member A-1 was mounted on a cyan station of the device; that conditions for potential were set so that the dark-area potential (Vd) was −500 V and the light-area potential (Vl) was −100 V in an environment of 23° C./50% RH, and the initial potential of the electrophotographic photosensitive member was adjusted; and that the cleaning blade was set at a contact angle of 24° with respect to the peripheral surface of the electrophotographic photosensitive member, and the linear pressure (contact pressure) to the peripheral surface of the electrophotographic photosensitive member was set at 15 g/cm, which was about one fifth the value normally set. The results thereof are shown in Table 3.

Examples 33 to 48

Evaluation was performed as in Example 32 except that the electrophotographic photosensitive member to be evaluated was changed to the electrophotographic photosensitive members shown in Table 3. The results thereof are shown in Table 3.

Example 49

Evaluation was performed as in Example 1, except that the evaluation device was changed to a modified device of an electrophotographic copying machine (trade name: GP-40) manufactured by CANON KABUSHIKI KAISHA, and the electrophotographic photosensitive member A-1 was mounted on the device; that conditions for potential were set so that the dark-area potential (Vd) was −700 V and the light-area potential (Vl) was −150 V in an environment of 23° C./50% RH, and the initial potential of the electrophotographic photosensitive member was adjusted; and that the cleaning blade was set at a contact angle of 25° with respect to the peripheral surface of the electrophotographic photosensitive member, and the linear pressure (contact pressure) was set at 15 g/cm, which was about half the value normally set. The results thereof are shown in Table 3.

Example 50

Evaluation was performed as in Example 49 except that the electrophotographic photosensitive member to be evaluated was changed to the electrophotographic photosensitive member B-1. The results thereof are shown in Table 3.

Example 51

Evaluation was performed as in Example 1, except that the evaluation device was changed to a modified device of a laser beam printer (trade name: Color Laser Jet 3500) manufactured by Hewlett-Packard Company, and the electrophotographic photosensitive member A-24 was mounted on a cyan station of the device; that conditions for potential were set so that the dark-area potential (Vd) was −500 V and the light-area potential (Vl) was −150 V in an environment of 23° C./50% RH, and the initial potential of the electrophotographic photosensitive member was adjusted; and that the cleaning blade was set at a contact angle of 24° with respect to the peripheral surface of the electrophotographic photosensitive member, and the linear pressure (contact pressure) was set at 15 g/cm, which was about one fifth the value normally set. The results thereof are shown in Table 3.

Example 52

Evaluation was performed as in Example 51 except that the electrophotographic photosensitive member to be evaluated was changed to the electrophotographic photosensitive member B-9. The results thereof are shown in Table 3.

Comparative Example 1

Evaluation was performed as in Example 1 except that the electrophotographic photosensitive member to be evaluated was changed to the electrophotographic photosensitive member C-1. The results thereof are shown in Table 4.

Comparative Examples 2 to 6

Evaluation was performed as in Comparative Example 1 except that the electrophotographic photosensitive member to be evaluated was changed to the electrophotographic photosensitive members shown in Table 4. The results thereof are shown in Table 4.

Comparative Examples 7 to 9

Evaluation was performed as in Example 32 except that the electrophotographic photosensitive member to be evaluated was changed to the electrophotographic photosensitive member shown in Table 4. The results thereof are shown in Table 4.

Comparative Examples 10 to 14

Evaluation was performed as in Comparative Example 1 except that the electrophotographic photosensitive member to be evaluated was changed to the electrophotographic photosensitive members shown in Table 4. The results thereof are shown in Table 4.

Comparative Examples 15 to 17

Evaluation was performed as in Comparative Example 7 except that the electrophotographic photosensitive member to be evaluated was changed to the electrophotographic photosensitive members shown in Table 4. The results thereof are shown in Table 4.

Comparative Examples 18 to 22

Evaluation was performed as in Comparative Example 1 except that the electrophotographic photosensitive member to be evaluated was changed to the electrophotographic photosensitive members shown in Table 4. The results thereof are shown in Table 4.

Comparative Examples 23 to 25

Evaluation was performed as in Comparative Example 7 except that the electrophotographic photosensitive member to be evaluated was changed to the electrophotographic photosensitive members shown in Table 4. The results thereof are shown in Table 4.

TABLE 3

| | Electro-photographic photosensitive member | Cleaning property evaluation (15° C.-10% RH/ 23° C.-50% RH/ 30° C.-80% RH) | Dot reproduc-ibility |
|---|---|---|---|
| Example 1 | A-1 | A/A/A | A |
| Example 2 | A-2 | A/A/A | A |
| Example 3 | A-3 | A/A/A | A |
| Example 4 | A-4 | A/A/A | A |
| Example 5 | A-5 | A/A/A | A |
| Example 6 | A-6 | A/A/A | A |
| Example 7 | A-7 | A/A/A | A |
| Example 8 | A-8 | B/A/A | B |
| Example 9 | A-9 | B/A/B | A |
| Example 10 | A-10 | A/A/A | A |
| Example 11 | A-11 | A/A/A | A |
| Example 12 | A-12 | A/A/A | A |
| Example 13 | A-13 | A/A/A | A |
| Example 14 | A-14 | B/A/A | C |
| Example 15 | A-15 | A/A/A | A |
| Example 16 | A-16 | A/A/A | C |
| Example 17 | A-17 | A/A/A | A |
| Example 18 | A-18 | A/A/A | C |
| Example 19 | A-19 | C/B/B | D |
| Example 20 | A-20 | A/A/A | A |
| Example 21 | A-21 | A/A/A | A |
| Example 22 | A-22 | A/A/A | A |
| Example 23 | A-23 | A/A/A | A |
| Example 24 | B-1 | A/A/A | A |
| Example 25 | B-2 | A/A/A | A |
| Example 26 | B-3 | A/A/A | A |
| Example 27 | B-4 | C/B/B | D |
| Example 28 | B-5 | A/A/A | A |
| Example 29 | B-6 | A/A/A | A |
| Example 30 | B-7 | A/A/A | A |
| Example 31 | B-8 | C/B/B | D |
| Example 32 | A-1 | A/A/A | A |
| Example 33 | A-3 | A/A/A | A |
| Example 34 | A-7 | A/A/A | A |
| Example 35 | A-13 | A/A/A | A |
| Example 36 | A-16 | A/A/A | C |
| Example 37 | A-18 | A/A/A | C |
| Example 38 | A-19 | C/B/B | D |
| Example 39 | A-22 | A/A/A | A |
| Example 40 | A-23 | A/A/A | A |
| Example 41 | B-1 | A/A/A | A |
| Example 42 | B-2 | A/A/A | A |
| Example 43 | B-3 | A/A/A | A |
| Example 44 | B-4 | C/B/B | D |
| Example 45 | B-5 | A/A/A | A |
| Example 46 | B-6 | A/A/A | A |
| Example 47 | B-7 | A/A/A | A |
| Example 48 | B-8 | C/B/B | D |
| Example 49 | A-1 | A/A/A | A |
| Example 50 | B-1 | A/A/A | A |
| Example 51 | A-24 | A/A/A | A |
| Example 52 | B-9 | A/A/A | A |

TABLE 4

| | Electro-photographic photosensitive member | Cleaning property evaluation (15° C.-10% RH/ 23° C.-50% RH/ 30° C.-80% RH) | Dot reproduc-ibility |
|---|---|---|---|
| Comparative Example 1 | C-1 | D/D/D | — |
| Comparative Example 2 | C-2 | D/D/D | — |
| Comparative Example 3 | C-3 | D/C/C | E |
| Comparative Example 4 | C-4 | D/D/D | — |
| Comparative Example 5 | C-5 | D/D/D | — |
| Comparative Example 6 | C-6 | D/D/D | — |

TABLE 4-continued

| | Electro-photographic photosensitive member | Cleaning property evaluation (15° C.-10% RH/ 23° C.-50% RH/ 30° C.-80% RH) | Dot reproduc-ibility |
|---|---|---|---|
| Comparative Example 7 | C-2 | D/D/D | — |
| Comparative Example 8 | C-3 | D/C/C | E |
| Comparative Example 9 | C-4 | D/D/D | — |
| Comparative Example 10 | D-1 | D/D/D | — |
| Comparative Example 11 | D-2 | D/D/D | — |
| Comparative Example 12 | D-3 | D/C/C | E |
| Comparative Example 13 | D-4 | D/D/D | — |
| Comparative Example 14 | D-5 | D/D/D | — |
| Comparative Example 15 | D-2 | D/D/D | — |
| Comparative Example 16 | D-3 | D/C/C | E |
| Comparative Example 17 | D-4 | D/D/D | — |
| Comparative Example 18 | D-6 | D/D/D | — |
| Comparative Example 19 | D-7 | D/D/D | — |
| Comparative Example 20 | D-8 | D/C/C | E |
| Comparative Example 21 | D-9 | D/D/D | — |
| Comparative Example 22 | D-10 | D/D/D | — |
| Comparative Example 23 | D-7 | D/D/D | — |
| Comparative Example 24 | D-8 | D/C/C | E |
| Comparative Example 25 | D-9 | D/D/D | — |

Evaluation of Durability of Electrophotographic Photosensitive Member

Example 101

In Example 1, a durability test was performed in which, in an environment of 23° C./50% RH, 50,000 sheets of A4 landscape-oriented paper were printed in a 5-sheet intermittent mode, using a test chart having a coverage rate of 5%. After that, cleaning performance and dot reproducibility were evaluated as in Example 1. The results thereof are shown in Table 5.

Examples 102 to 110

Evaluation was performed as in Example 101 except that the electrophotographic photosensitive member to be evaluated was changed to the electrophotographic photosensitive members shown in Table 5 and the number of sheets printed was changed to that shown in Table 5. The results thereof are shown in Table 5.

Example 111

In Example 32, a durability test was performed in which, in an environment of 23° C./50% RH, 50,000 sheets of A4 landscape-oriented paper were printed in a 5-sheet intermittent mode, using a test chart having a coverage rate of 5%. After that, cleaning performance and dot reproducibility were evaluated as in Example 1. The results thereof are shown in Table 5.

Examples 112 to 115

Evaluation was performed as in Example 111 except that the electrophotographic photosensitive member to be evaluated was changed to the electrophotographic photosensitive members shown in Table 5 and the number of sheets printed was changed to that shown in Table 5. The results thereof are shown in Table 5.

TABLE 5

| | Electro-photographic photosensitive member | Number of sheets printed | Cleaning performance evaluation (15° C.-10% RH/ 23° C.-50% RH/ 30° C.-80% RH) | Dot reproduc-ibility |
|---|---|---|---|---|
| Example 101 | A-1 | 50000 | A/A/A | A |
| Example 102 | A-4 | 50000 | A/A/A | A |
| Example 103 | A-10 | 50000 | A/A/A | A |
| Example 104 | A-13 | 50000 | A/A/A | A |
| Example 105 | A-20 | 50000 | A/A/A | A |
| Example 106 | A-21 | 50000 | A/A/A | A |
| Example 107 | A-22 | 50000 | A/A/A | A |
| Example 108 | A-23 | 50000 | A/A/A | A |
| Example 109 | B-1 | 5000 | A/A/A | A |
| Example 110 | B-5 | 5000 | A/A/A | A |
| Example 111 | A-1 | 50000 | A/A/A | A |
| Example 112 | A-22 | 50000 | A/A/A | A |
| Example 113 | A-23 | 50000 | A/A/A | A |
| Example 114 | B-1 | 5000 | A/A/A | A |
| Example 115 | B-5 | 5000 | A/A/A | A |

According to the present invention, it is possible to provide an electrophotographic photosensitive member having excellent cleaning performance, and a process cartridge and an electrophotographic apparatus, each including the electrophotographic photosensitive member. Furthermore, according to the present invention, it is possible to provide an electrophotographic photosensitive member which has good dot reproducibility even if the peripheral surface is roughened, and a process cartridge and an electrophotographic apparatus, each including the electrophotographic photosensitive member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. An electrophotographic photosensitive member comprising:

a cylindrical support; and a photosensitive layer disposed on the cylindrical support, wherein, a peripheral surface of the electrophotographic photosensitive member has:

a plurality of flat portions having a width e (μm) that satisfies the relationship $0.1 \le e \le 25$, and a plurality of groove portions having a width w (μm) that satisfies the relationship $0.1 \le w \le 25$ and a depth d (μm) that satisfies the relationship $0.1 \le d \le 3.0$, the flat portions and the groove portions are alternately formed, each of the plurality of flat portions extends continuously without any intersecting groove portions in a circumferential direction across the entire electrophotographic photosensitive member, the sum $e_{sum}$ (μm) of the widths e of the flat portions per each width of 100 μm in the axial direction of the peripheral surface satisfies the relationship $10 \le e_{sum} \le 50$; and $e_\sigma/e_{Av}$ satisfies the relationship $e_\sigma/e_{Av} \le 0.46$, where $e_{Av}$ (μm) is an average value of the widths e of the flat portions, and $e_\sigma$ is a standard deviation thereof.

2. The electrophotographic photosensitive member according to claim 1, wherein the $e_\sigma/e_{Av}$ satisfies the relationship $e_\sigma/e_{Av} \le 0.27$.

3. The electrophotographic photosensitive member according to claim 2, wherein the $e_\sigma/e_{Av}$ satisfies the relationship $e_\sigma/e_{Av} \le 0.08$.

4. The electrophotographic photosensitive member according to claim 1, wherein $w_\sigma/w_{Av}$ satisfies the relationship $w_\sigma/w_{Av} \le 0.08$, and $d_\sigma/d_{Av}$ satisfies the relationship $d_\sigma/d_{Av} \le 0.08$, where $w_{Av}$ (μm) is the average value of the widths w of the groove portions, $w_\sigma$ is the standard deviation thereof, $d_{Av}$ (μm) is the average value of the depths d of the groove portions, and $d_\sigma$ is the standard deviation thereof.

5. A process cartridge which integrally holds:

the electrophotographic photosensitive member according to claim 1, and at least one means selected from the group consisting of:

charging means for charging a peripheral surface of the electrophotographic photosensitive member, developing means for developing an electrostatic latent image formed on the peripheral surface of the electrophotographic photosensitive member with a toner to form a toner image on the peripheral surface of the electrophotographic photosensitive member, transferring means for transferring the toner image formed on the peripheral surface of the electrophotographic photosensitive member to a transfer medium, and cleaning means for removing toner remaining on the peripheral surface of the electrophotographic photosensitive member after the toner image formed on the peripheral surface of the electrophotographic photosensitive member has been transferred to the transfer medium, the process cartridge being characterized by being detachably mountable to a main body of an electrophotographic apparatus.

6. An electrophotographic apparatus characterized by comprising:

the electrophotographic photosensitive member according to claim 1;

charging means for charging the electrophotographic photosensitive member;

exposing means for irradiating, with exposure light, a peripheral surface of the electrophotographic photosensitive member which has been charged to form an electrostatic latent image on the peripheral surface of the electrophotographic photosensitive member;

developing means for developing the electrostatic latent image formed on the surface of the electrophotographic photosensitive member with a toner to form a toner image on the peripheral surface of the electrophotographic photosensitive member; and transferring means for transferring the toner image formed on the peripheral surface of the electrophotographic photosensitive member to a transfer medium.

7. The electrophotographic photosensitive member according to claim 1, wherein each of the plurality of grooves have a long uninterrupted edge in a circumferential direction, and the length of the uninterrupted edge is greater than the width of the groove.

8. The electrophotographic photosensitive member according to claim 7, wherein the length of the uninterrupted edge is much greater than the width of the groove.

9. The process cartridge according to claim 5, wherein all of the flat portions and all of the groove portions on the peripheral surface of the electrophotographic photosensitive member that are in contact with the cleaning means satisfy the relationship $80 \leq \theta \leq 100$ with respect to the axial direction of the electrophotographic photosensitive member.

* * * * *